US008738242B2

(12) United States Patent
Konno et al.

(10) Patent No.: US 8,738,242 B2
(45) Date of Patent: May 27, 2014

(54) AUTOMATIC BLADE SLOPE CONTROL SYSTEM

(75) Inventors: Hiroyuki Konno, Livermore, CA (US); Vernon Joseph Brabec, Livermore, CA (US); Renard Tomas Graham, Antioch, CA (US)

(73) Assignee: Topcon Positioning Systems, Inc., Livermore, CA (US)

( * ) Notice: Subject to any disclaimer, the term of this patent is extended or adjusted under 35 U.S.C. 154(b) by 184 days.

(21) Appl. No.: 13/187,831

(22) Filed: Jul. 21, 2011

(65) Prior Publication Data

US 2012/0239258 A1 Sep. 20, 2012

Related U.S. Application Data

(60) Provisional application No. 61/453,256, filed on Mar. 16, 2011.

(51) Int. Cl.
*E02F 3/84* (2006.01)

(52) U.S. Cl.
USPC ..... 701/50; 172/4.5; 172/25; 172/49.5; 172/58; 172/59; 172/60; 37/348

(58) Field of Classification Search
USPC ..... 701/50; 342/357.52; 172/4.5, 2, 25, 172/49.5, 58–60; 37/348
See application file for complete search history.

(56) References Cited

U.S. PATENT DOCUMENTS 3,974,699 A * 8/1976 Morris et al. ..... 73/865.9
4,600,999 A * 7/1986 Ito et al. ..... 701/25
5,375,663 A * 12/1994 Teach ..... 172/4.5
5,499,684 A * 3/1996 Stratton ..... 172/4.5
5,551,518 A * 9/1996 Stratton ..... 172/4.5
5,951,613 A 9/1999 Sahm et al.
6,112,145 A 8/2000 Zachman
6,128,574 A * 10/2000 Diekhans ..... 701/410
6,129,156 A 10/2000 Boast et al.

(Continued)

FOREIGN PATENT DOCUMENTS

EP 1 630 636 3/2006

OTHER PUBLICATIONS

Craig K., "Sensor Fusion", pp. 1-24, downloaded on Mar. 7, 2011, from http://multimechatronics.com/images/uploads/mech_n/Sensor_Fusion.pdf.

(Continued)

*Primary Examiner* — Tuan C. To
(74) *Attorney, Agent, or Firm* — Wolff & Samson, PC

(57) ABSTRACT

The slope angle of a blade on an earthmoving machine is automatically controlled based on measurements from a three-axis gyroscope, a blade slope angle tilt sensor, and a blade tip angle tilt sensor mounted on the blade. A three-axis gyroscope has high dynamic response and high resistance to mechanical disturbances but is subject to potentially unbounded errors. A tilt sensor has bounded errors but has a slow dynamic response and a high sensitivity to mechanical disturbances. The combination of a three-axis gyroscope and two tilt sensors provides an advantageous measurement system. Algorithms for performing proper fusion of the measurements account for the lack of synchronization between the three-axis gyroscope and the tilt sensors and also screen out invalid measurements from the tilt sensors. The blade slope angle is controlled based on a reference blade slope angle and an estimate of the blade slope angle computed from properly fused measurements.

36 Claims, 13 Drawing Sheets

(56) References Cited

U.S. PATENT DOCUMENTS

| | | | | |
|---|---|---|---|---|
| 6,236,924 | B1 * | 5/2001 | Motz et al. | 701/50 |
| 6,450,267 | B2 * | 9/2002 | Ohtomo et al. | 172/4.5 |
| 7,246,456 | B2 * | 7/2007 | Wray | 37/382 |
| 7,317,977 | B2 | 1/2008 | Matrosov | |
| 7,516,563 | B2 * | 4/2009 | Koch | 37/348 |
| 7,942,208 | B2 * | 5/2011 | Hughes et al. | 172/4.5 |
| 8,103,417 | B2 * | 1/2012 | Gharsalli et al. | 701/50 |
| 8,333,250 | B2 * | 12/2012 | Knepper et al. | 172/781 |
| 8,596,373 | B2 * | 12/2013 | Montgomery et al. | 172/4.5 |
| 2002/0162668 | A1 | 11/2002 | Carlson et al. | |
| 2006/0198700 | A1 | 9/2006 | Maier et al. | |
| 2006/0230645 | A1 * | 10/2006 | McCain | 37/348 |
| 2008/0097693 | A1 * | 4/2008 | McCain | 701/213 |
| 2008/0109141 | A1 | 5/2008 | Nichols et al. | |
| 2008/0133128 | A1 * | 6/2008 | Koch | 701/207 |
| 2009/0069987 | A1 | 3/2009 | Omelchenko et al. | |
| 2009/0259373 | A1 * | 10/2009 | Nichols et al. | 701/50 |
| 2010/0076640 | A1 * | 3/2010 | Maekawa et al. | 701/26 |
| 2013/0006484 | A1 * | 1/2013 | Avitzur et al. | 701/50 |

OTHER PUBLICATIONS

Craig K., "Sensor Fusion—It's Hot!", Design News. p. 16, Nov. 2009.

PCT International Search Report corresponding to PCT Application No. PCT/US2011/001423 filed Aug. 12, 2011 (4 pages).

PCT Written Opinion of the International Searching Authority corresponding to PCT Application No. PCT/US2011/001423 filed Aug. 12, 2011 (7 pages).

* cited by examiner

AUTOMATIC BLADE SLOPE CONTROL SYSTEM

This application claims the benefit of U.S. Provisional Application No. 61/453,256 filed Mar. 16, 2011, which is incorporated herein by reference.

BACKGROUND OF THE INVENTION

The present invention relates generally to earthmoving machines, and more particularly to automatic blade slope control.

Construction machines referred to as earthmoving machines are used to shape a plot of land into a desired ground profile. Examples of earthmoving machines include bulldozers and motor graders. Bulldozers are used primarily for coarse movement of earth; motor graders are used primarily for fine control of the final ground profile. Bulldozers and motor graders are equipped with a blade to move earth. The blade position and blade attitude are adjustable. Blade position can be specified by parameters such as blade elevation and blade sideshift. Blade attitude can be specified by parameters such as blade tip angle and blade slope angle.

Blade position and blade attitude are often manually controlled by a machine operator. To improve operational speed and precision, automatic control is desirable. Various automatic control systems have been deployed. They vary in complexity, cost, number of parameters controlled, response time, and precision.

BRIEF SUMMARY OF THE INVENTION

A blade mounted on a vehicle is automatically controlled based on measurements received from a three-axis gyroscope and two tilt sensors mounted on the blade. Measurements from the three-axis gyroscope include angular velocity measurements about three orthogonal axes. Measurements from the two tilt sensors include a blade slope angle and a blade tip angle. Measurements from the three-axis gyroscope and the two tilt sensors are fused. The three-axis gyroscope and the tilt sensors are not synchronized. Algorithms for proper fusion of the measurements account for the time sequence of the measurements. A measurement from a tilt sensor is not fused with measurements from the three-axis gyroscope if the measurement from the tilt sensor is older than the measurements from the three-axis gyroscope. A measurement from a tilt sensor is also not fused with measurements from the three-axis gyroscope if the measurement from the tilt sensor is invalid due to mechanical disturbances.

An estimate of the blade slope angle is computed from properly fused measurements. The blade slope angle is controlled based on a reference blade slope angle and the computed estimate of the blade slope angle. A proportional-derivative control algorithm or a proportional control algorithm can be used.

Data processing algorithms and control algorithms can be stored as computer-executable code stored on a computer readable medium and executed by a computational system. A control signal outputted by the computational system can control a hydraulic system that controls the blade slope angle.

These and other advantages of the invention will be apparent to those of ordinary skill in the art by reference to the following detailed description and the accompanying drawings.

DETAILED DESCRIPTION

Earthmoving machines, such as bulldozers and motor graders, are equipped with a blade to move earth. The blade position and blade attitude are controlled to shape the ground to a desired profile. The blade position and blade attitude can be controlled manually by a machine operator or automatically by an automatic blade control system. Combinations of manual and automatic control are often used. The blade parameters placed under automatic control are dependent on the application, type of earthmoving machine, desired precision, response time, and the complexity and cost of the automatic control system.

Figure 1A:
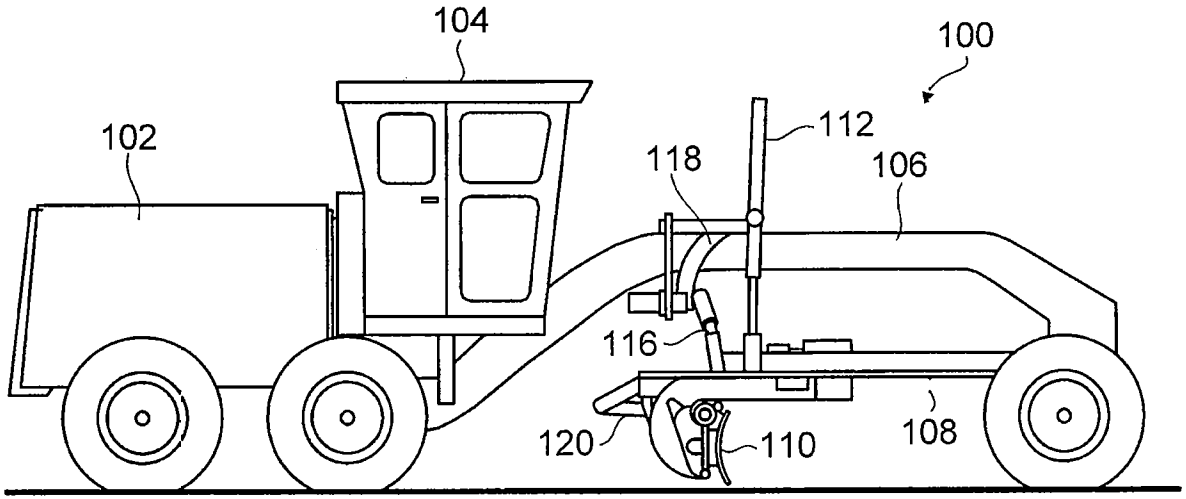
FIG. 1A and FIG. 1B show a side view and a top view, respectively, of a motor grader.
Figure 1B:
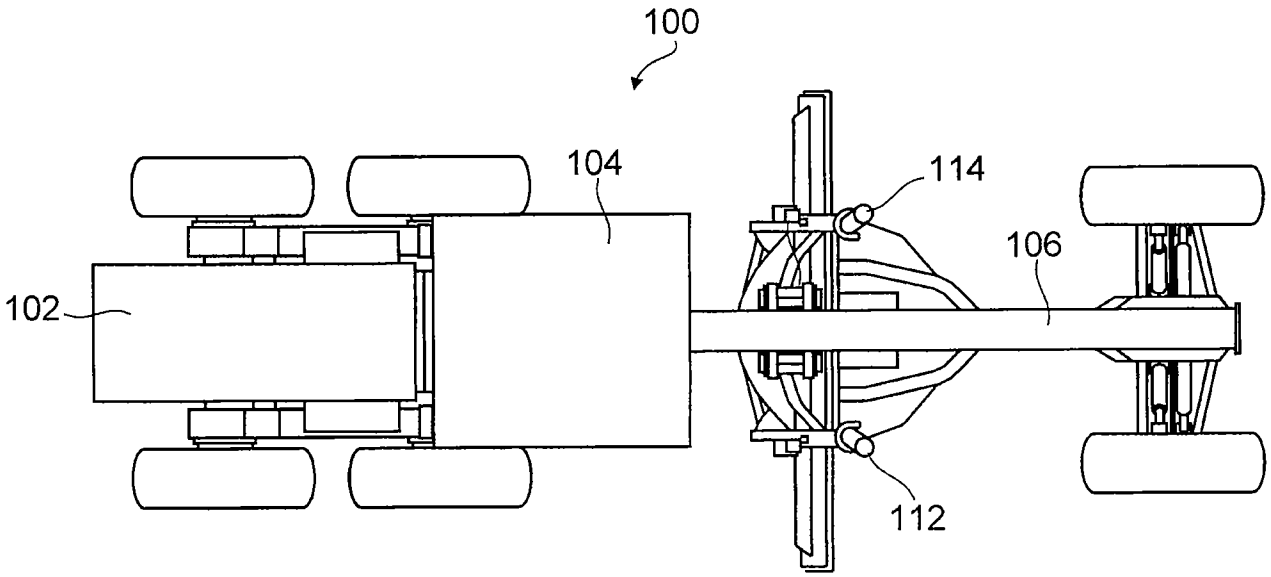

For a motor grader, primary blade parameters to be controlled are the blade slope angle and the blade elevation. FIG. 1A and FIG. 1B show a side view and a top view, respectively, of a motor grader 100. The motor grader 100 includes an engine 102, a cabin 104, and a front frame structure 106. The engine 102 is located at the rear of the motor grader 100, and the front frame structure 106 is located at the front of the motor grader 100. A machine operator (not shown) is seated in the cabin 104 and operates the motor grader 100.

A drawbar 108 is connected to the front frame structure 106 via a ball joint, and a blade 110 is mounted on the drawbar 108. The drawbar is also connected to three hydraulic cylinders: the right lift cylinder 112, the left lift cylinder 114, and the centershift cylinder 116. Note: "right" and "left" are specified with respect to the machine operator. The three hydraulic cylinders are connected to the front frame structure 106 via a coupling 118. The elevation and the slope angle of the blade 110 are controlled by the right lift center 112 and the left lift center 114. The centershift cylinder 116 is used to laterally shift the drawbar 108 relative to the front frame structure 106. The tip angle of the blade 110 is controlled by a fourth hydraulic cylinder, denoted the blade tip angle control cylinder 120. The blade slope angle and the blade tip angle are described in more detail below.

Figure 2:
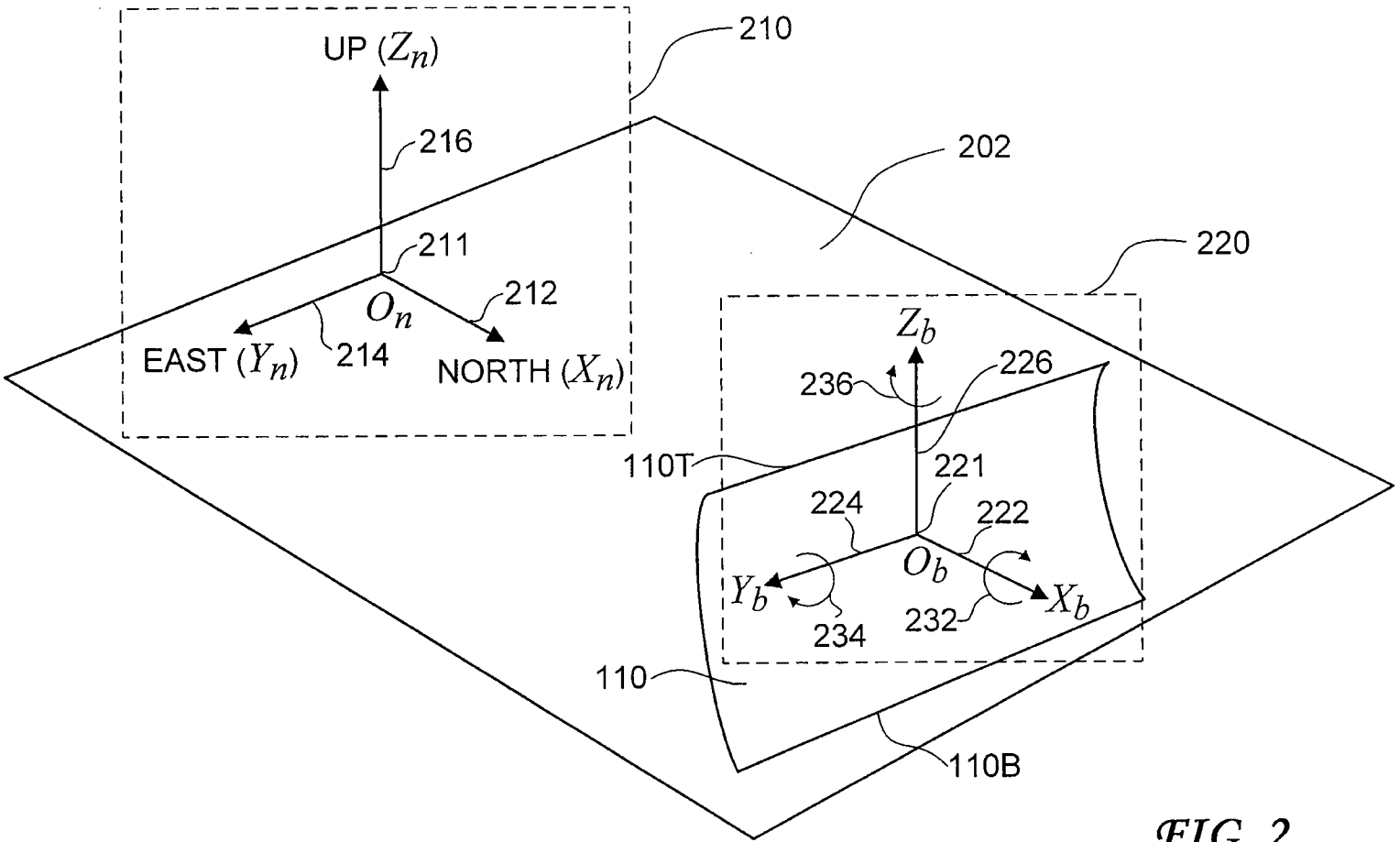
FIG. 2 shows reference coordinate systems.

FIG. 2 shows the reference frames used in the control algorithms described below. The navigation frame 210 is a Cartesian coordinate system used as a local navigation frame. The origin of the navigation frame 210 is denoted $O_n$ 211, and the axes are denoted North-East-Up (NEU). The NEU axes are also denoted $X_n$-axis 212, $Y_n$-axis 214, and $Z_n$-axis 216, respectively. The $X_n$-$Y_n$ plane is referred to as a local reference plane 202. The local reference plane 202 (also referred to as a local level plane) and the origin $O_n$ 211 are defined, for example, by a site engineer. A common practice is to define the local reference plane 202 such that the $Z_n$-axis 216 is parallel to the local gravitational force vector. In some practices, the local reference plane 202 is tangent to the World Geodetic System (WGS-84) Earth ellipsoid or parallel to the tangent plane.

The blade frame 220 is a Cartesian coordinate system fixed with respect to the blade 110. The top edge of the blade 110 is denoted the blade top edge 110T. The bottom edge of the blade 110 is denoted the blade bottom edge 110B. The origin of the blade frame 220 is denoted $O_b$ 221, and the axes are denoted $X_b$-axis 222, $Y_b$-axis 224, and $Z_b$-axis 226. The positive direction of the $X_b$-axis 222 points away from the front surface of the blade 110. Note that the navigation frame 210 and the blade frame 220 both follow the left-hand rule.

The blade angular rotation rates about the $X_b$-axis 222, $Y_b$-axis 224, and $Z_b$-axis 226 are denoted $\omega_x$ 232, $\omega_y$ 234, and $\omega_z$ 236, respectively. To simplify the notation, the subscript$_b$ in the blade angular rotation rates is omitted. The position of the origin $O_b$ 221 with respect to the blade 110 is defined by a user such as a control engineer. The orientation of the $X_b$-axis 222, $Y_b$-axis 224, and $Z_b$-axis 226 with respect to the blade 110 is defined by a user. Typically, to simplify equations used in control algorithms, it is advantageous to align the $Y_b$-axis 224 parallel to the blade bottom edge 110B.

Figure 3A:
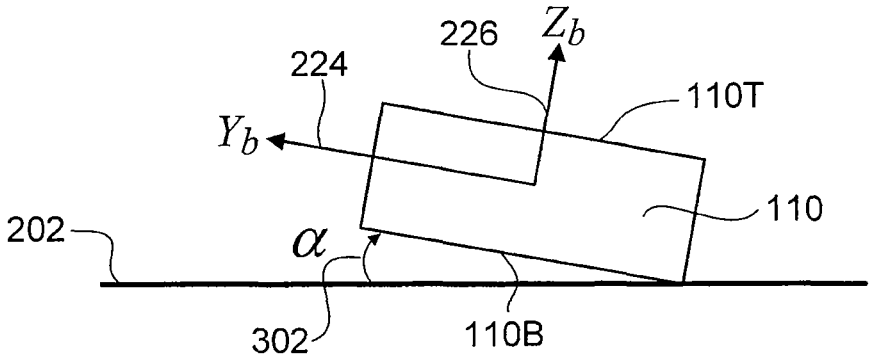
FIG. 3A and FIG. 3B show the definition of blade slope angle and blade tip angle, respectively.

Refer to FIG. 3A. The blade slope angle, denoted α 302, is defined as the angle of the blade bottom edge 110B relative to the local reference surface 202 in the navigation frame 210.

Figure 3B:
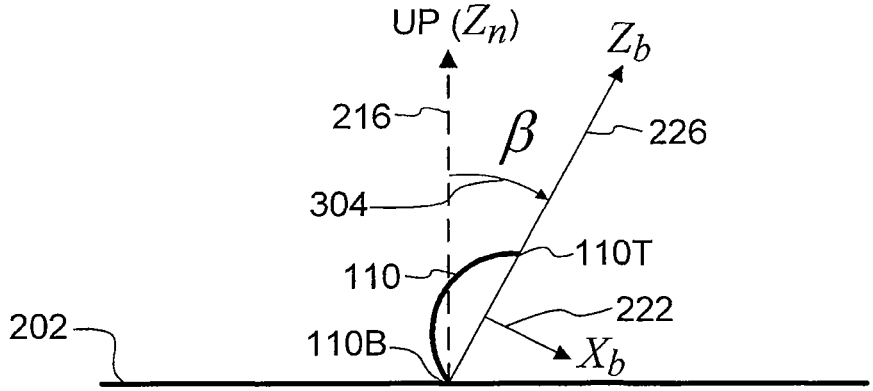

Refer to FIG. 3B. The blade tip angle, denoted β 304, is defined as the angle that the blade top edge 110T is tipped ahead of or behind the blade bottom edge 110B. The $Z_b$-axis 226 is aligned such that it intersects the blade bottom edge 110B and the blade top edge 110T. The blade tip angle β 304 is the angle of the $Z_b$-axis 226 with respect to the $Z_n$-axis 216 in the navigation frame 210.

In an embodiment of a blade control system, the machine operator manually controls the blade tip angle β 304 by shifting the blade tip angle control cylinder 120 (FIG. 1A) forward and backward, and an automatic blade slope control system automatically controls the blade slope angle α 302. Note that both the blade tip angle β 304 and the blade slope angle α 302 can be intentionally varied during a grading operation.

To control the blade slope angle under dynamic motion, accurate and fast estimation of the blade slope angle is necessary. Tilt sensors are widely used for estimating the blade slope angle. In general, a tilt sensor measures an inclination angle with respect to the local reference surface by sensing the local gravitational force vector. Various types of tilt sensors are available; for example, microelectromechanical systems (MEMS) transducers and liquid inclinometers.

Although tilt sensors can provide accurate and stable blade slope angle measurements, they have two major drawbacks. First, tilt sensors show slow response to rapid and large changes of the blade slope angle. The slow response time in the blade slope angle measurement is due to the internal filters used to reduce noise; these filters limit the response time and the control speed. Second, tilt sensors work properly only under a limited range of dynamic motion. As discussed above, tilt sensors sense the local gravitational force vector to measure the blade slope angle. A high dynamic motion, however, induces additional acceleration components on the tilt sensors. These additional acceleration components perturb the sensing of the local gravitational force vector and results in errors in the blade slope angle measurement. The vulnerability to high dynamic motions degrades the performance of the control systems under high dynamic motions of the motor grader (or other earthmoving machine). High dynamic motions can result, for example, from sudden braking or turning.

In an embodiment, the drawbacks of tilt sensors are overcome by combining tilt sensors with a three-axis gyroscope, which provides angular rotation measurements from three orthogonally-placed rate gyros. A three-axis gyroscope can be assembled in various configurations: as an integrated three-axis unit, as a combination of a single-axis unit and a two-axis unit, or as a combination of three single-axis units. A three-axis gyroscope generally provides attitude measurements with a high sampling rate by integrating the outputs from the three orthogonally-placed rate gyros. Examples of rate gyros include microelectromechanical systems (MEMS) and fiber-optic units. For earthmoving machines, MEMS units are advantageous because of their ruggedness and low cost. In contrast to a tilt sensor, a three-axis gyroscope shows significantly less delay in the attitude measurement, and the attitude measurement is not degraded by dynamic motions that occur during operation. A three-axis gyroscope does have a significant drawback, however. Any sensor errors are accumulated in the computation of the attitude, and attitude errors are potentially unbounded.

By integrating tilt sensors and a three-axis gyroscope, tilt sensor measurements that have long-term accuracy and stability compensate for the gyroscope errors. A three-axis gyroscope, in turn, provides attitude measurements with small delays and high sampling rates; these attitude measurements retain high short-term accuracy regardless of dynamic motion.

In addition to the improvement in the attitude measurements, a combination of tilt sensors and a three-axis gyroscope permits an automatic blade slope control system to use a proportional-and-derivative (PD) control algorithm. In an embodiment, a PD control algorithm uses parameters (discussed in detail below) calculated from the blade slope angle measured by one tilt sensor, the blade tip angle measured by a second tilt sensor, and the blade angular rotation rates measured by a three-axis gyroscope. The blade angular rotation rate feedback in the controller advantageously increases the speed of the blade slope angle control while maintaining accuracy and stability. As described below, measurements from two tilt sensors are used because of coupling between the blade tip angle and the blade slope angle when performing transformations between the navigation frame and the blade frame.

Figure 4A:
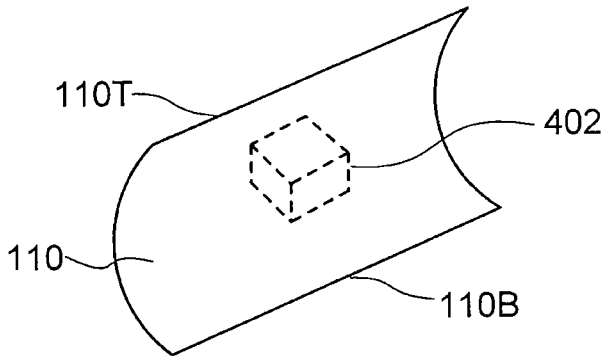
FIG. 4A and FIG. 4B show two mounting configurations for a sensor unit.

In the embodiment shown in FIG. 4A, a sensor unit 402 is mounted on the back of the blade 110. The sensor unit 402 includes two tilt sensors and a three-axis gyroscope (not shown). The first tilt sensor is mounted such that it measures the blade slope angle α 302 in the navigation frame 210 (FIG. 3A). The second tilt sensor is mounted such that it measures the blade tip angle β 304 in the navigation frame 210 (FIG. 3B). The three-axis gyroscope includes three orthogonally-placed rate gyros. The sensitive axis of the first, second, and third rate gyros coincide with the $X_b$-axis 222, $Y_b$-axis 224, and $Z_b$-axis 226, respectively, in the blade frame 220 (FIG. 2). The first, second, and third rate gyros measure the blade angular rotation rates $\omega_x$ 232, $\omega_y$ 234, and $\omega_z$ 236, respectively, in the blade frame 220.

Figure 4B:
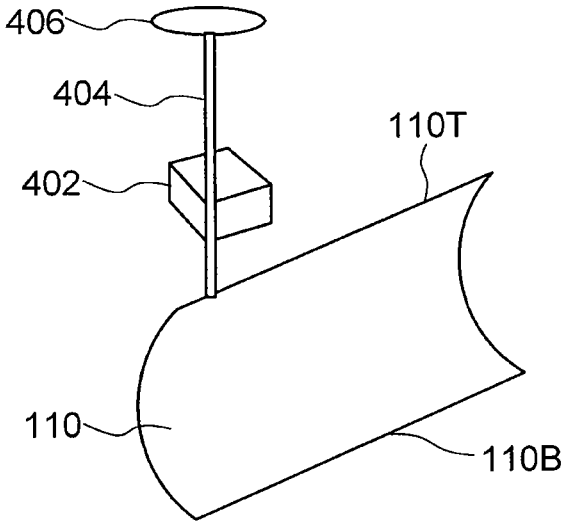

In the embodiment shown in FIG. 4B, the sensor unit 402 is mounted on a post 404 attached to the blade 110. The post 404 can be installed specifically for the sensor unit 402. The post 404 can also be used for the mounting of other measurement equipment. In the example shown in FIG. 4B, an antenna 406 is mounted on the post 404. The antenna 406 is used to receive global navigation satellite system (GNSS) signals when a GNSS is deployed to measure the position of the blade 110. In another example, an optical receiver (not shown) is mounted on the post 404 when a laser system is deployed to measure the elevation of the blade 110.

Herein, a sensor fixed to the blade 110 refers to a sensor whose position and orientation are fixed relative to the blade frame 220. A sensor fixed to the blade 110 can be mounted directly on the blade 110 (FIG. 4A) or mounted on a support rigidly attached to the blade 110 (for example, the post 404 in FIG. 4B). In FIG. 4A and FIG. 4B, the tilt sensors and the three-axis gyroscope are shown as a single assembly, the sensor unit 402. In other embodiments, the tilt sensors and the three-axis gyroscope are configured as separate assemblies. If tilt sensors are already fixed to the blade for a previous measurement or control system, a three-axis gyroscope can be separately fixed to the blade. Costs can therefore be reduced by using the existing tilt sensors.

Figure 5A:
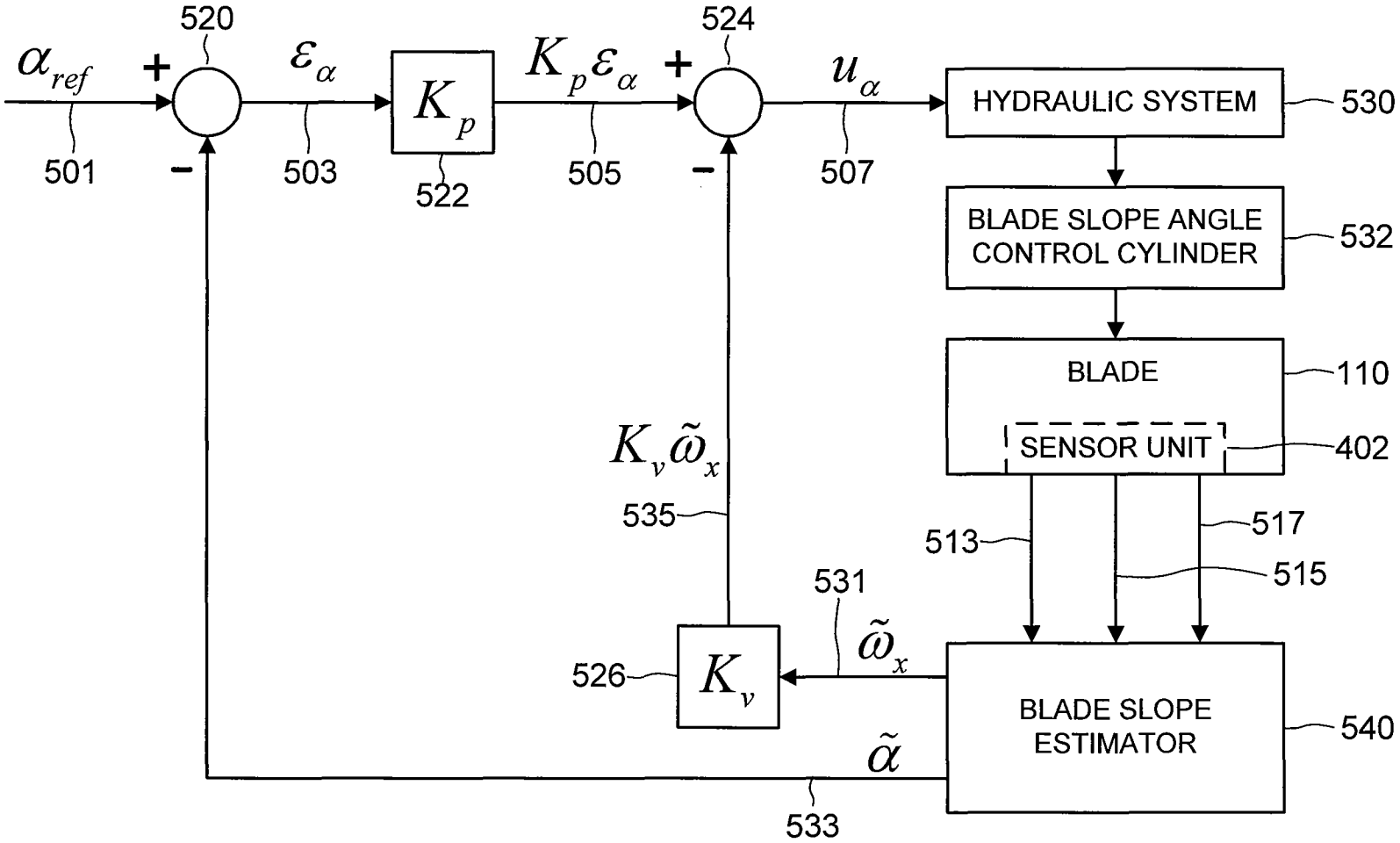
FIG. 5A shows a schematic of a proportional-derivative control algorithm for automatic blade slope control.
Figure 6A:
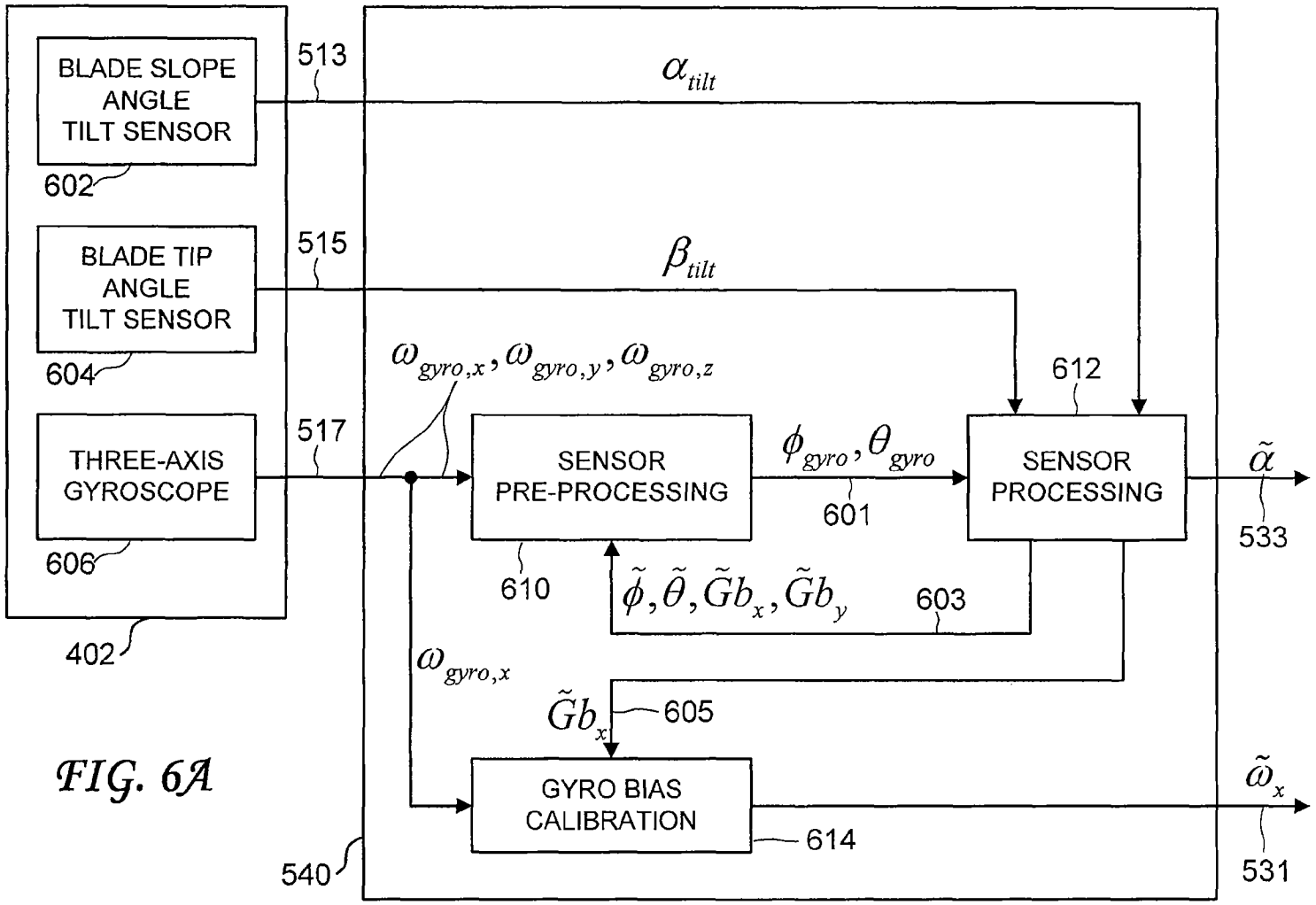
FIG. 6A shows a schematic of a blade slope estimator module for a proportional-derivative control algorithm.

Schematic diagrams of an automatic blade slope control system according to an embodiment are shown in FIG. 5A and FIG. 6A. FIG. 5A shows a schematic of a proportional-and-derivative (PD) control algorithm for the blade slope angle $\alpha$ 302. Control signal $u_\alpha$ 507 is inputted into a hydraulic system 530 that controls the hydraulic cylinders in the motor grader 100 (FIG. 1A and FIG. 1B). Hydraulic systems are well known in the art, and details are not described herein. As discussed above, the blade elevation and the blade slope angle $\alpha$ 302 are controlled by the right lift cylinder 112 and the left lift cylinder 114. In general, both the right lift cylinder 112 and the left lift cylinder 114 can be adjusted to control the blade elevation, and both the right lift cylinder 112 and the left lift cylinder 114 can be adjusted to control the blade slope angle $\alpha$ 302. In an embodiment, one cylinder (referred to as the blade elevation control cylinder) is used to control the blade elevation and the other cylinder (referred to as the blade slope angle control cylinder) is used to control the blade slope angle $\alpha$ 302. In one convention, the right lift cylinder 112 serves as the blade elevation control cylinder and the left lift cylinder 114 serves as the blade slope angle control cylinder; however, the roles of the two cylinders can be interchanged.

In an embodiment, the control signal $u_\alpha$ 507 is an electrical signal that controls an electrically-controlled valve in the hydraulic system 530. The hydraulic system 530 controls the displacement of the blade slope angle control cylinder 532 that controls the blade slope angle $\alpha$ 302 of the blade 110. The sensor unit 402 fixed to the blade 110 sends a sensor signal 513, a sensor signal 515, and a sensor signal 517 to the blade slope estimator module 540. Further details are described below. The blade slope estimator module 540 refers to a functional module. Implementation of the functional module is discussed below.

The sensor signal 513, the sensor signal 515, and the sensor signal 517 provide raw measurements that include errors. The blade slope estimator module 540 performs computations that reduce various errors. The outputs of the blade slope estimator module 540 are output 531, which represents the blade angular rotation rate estimate $\tilde{\omega}_x$ about the $X_b$-axis 222, and output 533, which represents the blade slope angle estimate $\tilde{\alpha}$. Estimates are discussed below.

The control signal $u_\alpha$ 507 is calculated as follows. The input $\alpha_{ref}$ 501 represents the reference (desired) value of the blade slope angle. The input $\alpha_{ref}$ 501 can be intentionally varied during different stages of a grading operation. In one embodiment, $\alpha_{ref}$ 501 is manually inputted by a machine operator or a site engineer. In another embodiment, a mathematical model of the desired terrain profile is generated, and the values of $\alpha_{ref}$ 501 are automatically computed based on the current blade position in the terrain model.

At operation 520, the blade slope angle estimate $\tilde{\alpha}$ 533, computed by the blade slope estimator module 540, is subtracted from the reference blade slope angle $\alpha_{ref}$ 501 to yield the blade slope angle error $\epsilon_\alpha$ 503. At operation 522, the blade slope angle error $\epsilon_\alpha$ 503 is multiplied by the proportional control gain $K_p$ to yield the product $K_p\epsilon_\alpha$ 505. At operation 526, the blade angular rotation rate estimate $\tilde{\omega}_x$ 531 about the $X_b$-axis 222, computed by the blade slope estimator module 540, is multiplied by the velocity control gain $K_v$ to yield the product $K_v\tilde{\omega}_x$ 535. At operation 524, the product $K_v\tilde{\omega}_x$ 535 is subtracted from the product $K_p\epsilon_\alpha$ 505 to yield the control signal $u_\alpha$ 507. The goal of the PD control algorithm is to maintain the blade slope angle error $\epsilon_\alpha$ 503 within user-defined limits. These limits are defined, for example, by a site engineer or control engineer.

Refer to FIG. 6A. Shown are the sensor unit 402 and the blade slope estimator module 540. The sensor unit 402 includes a blade slope angle tilt sensor 602, a blade tip angle tilt sensor 604, and a three-axis gyroscope 606. Measurements outputted by the sensor unit 402 are referred to as raw measurements. The blade slope estimator module 540 includes a sensor pre-processing module 610, a sensor processing module 612, and a gyro bias calibration module 614. The sensor pre-processing module 610, the sensor processing module 612, and the gyro bias calibration module 614 refer to functional modules. Implementation of the functional modules are described below.

The blade slope angle tilt sensor 602 measures the blade slope angle in the navigation frame 210. The output of the blade slope angle tilt sensor 602 is denoted the blade slope angle $\alpha_{tilt}$. Due to factors such as measurement errors and measurement delays, this raw value in general can differ from the true value of the blade slope angle $\alpha$ 302. This raw value is transmitted in the sensor signal 513 from the sensor unit 402 to the blade slope estimator module 540.

The blade tip angle tilt sensor 604 measures the blade tip angle in the navigation frame 210. The output of the blade tip angle tilt sensor 604 is denoted the blade tip angle $\beta_{tilt}$. Due to factors such as measurement errors and measurement delays, this raw value in general can differ from the true value of the blade tip angle $\beta$ 304. This raw value is transmitted in the sensor signal 515 from the sensor unit 402 to the blade slope estimator module 540.

The three-axis gyroscope 606 measures the blade angular rotation rates $\omega_x$ 232, $\omega_y$ 234, and $\omega_z$ 236 about the $X_b$-axis 222, $Y_b$-axis 224, and $Z_b$-axis 226, respectively, in the blade frame 220 (FIG. 2). The raw blade angular rotation rates [denoted as ($\omega_{gyro,x}$, $\omega_{gyro,y}$, $\omega_{gyro,z}$)] are transmitted in the sensor signal 517 from the sensor unit 402 to the blade estimator module 540.

The ($\omega_{gyro,x}$, $\omega_{gyro,y}$, $\omega_{gyro,z}$) values are inputted into the sensor pre-processing module 610, which computes estimates of the parameters that represent the current blade attitude. In an embodiment, Euler angles (roll angle $\phi$, pitch angle $\theta$, and yaw angle $\psi$) are used to represent the current blade attitude. In another embodiment, a quaternion is used to represent the current blade attitude.

Details of computing the estimates of the Euler angles are discussed below. The output 601 of the sensor pre-processing module 610 includes the computed roll angle estimate $\phi_{gyro}$ and the computed pitch angle estimate $\theta_{gyro}$; these values are inputted into the sensor processing module 612. Under specific conditions, as discussed below, the sensor processing module 612 fuses the computed roll angle estimate $\phi_{gyro}$ and the computed pitch angle estimate $\theta_{gyro}$ with the blade slope angle $\alpha_{tilt}$ measured by the blade slope angle tilt sensor 602 and the blade tip angle $\beta_{tilt}$ measured by the blade tip angle tilt sensor 604. The sensor processing module 612 computes the blade slope angle estimate $\tilde{\alpha}$, the $X_b$-axis blade angular rotation rate estimate $\tilde{\omega}_x$, the corrected roll angle estimate $\tilde{\phi}$, the corrected pitch angle estimate $\tilde{\theta}$, the $X_b$-axis corrected gyro bias estimate $\tilde{G}b_x$, and the $Y_b$-axis corrected gyro bias estimate $\tilde{G}b_y$. Further details of the sensor processing module 612 are described below.

The fusion of the data collected from the blade slope angle tilt sensor 602, the blade tip angle tilt sensor 604, and the three-axis gyroscope 606 can provide corrections to the estimates computed from the three-axis gyroscope 606 alone. The corrected values are referred to as corrected estimates since there are residual errors; that is, the corrected values in general can differ from the true values. Gyro biases refer to offset errors in the measurements from the three-axis gyroscope 606; determination of the gyro biases is discussed in further detail below.

The output 603 of the sensor processing module 612 represents the corrected estimates $\tilde{\phi}$, $\tilde{\theta}$, $\tilde{G}b_x$, and $\tilde{G}b_y$; output 603 is fed back to the sensor pre-processing module 610 to improve the accuracy of subsequent estimates of $\phi_{gyro}$ and θgyro. Further details of the sensor pre-processing module 610 are described below. The output 605 of the sensor processing module 612 represents the $\tilde{G}b_x$ value; output 605 is inputted into the gyro bias calibration module 614. The output 533 of the sensor processing module 612 represents the blade slope angle estimate $\tilde{\alpha}$.

The gyro bias calibration module 614 receives the $\tilde{G}b_x$ value from the sensor processing module 612 and the raw $\omega_{gyro,x}$ value measured by the three-axis gyroscope 606. The output 531 of the gyro bias calibration module 614 represents the blade angular rotation rate estimate $\tilde{\omega}_x$. The blade angular rotation rate estimate $\tilde{\omega}_x$ is computed by subtracting $\tilde{G}b_x$ from $\omega_{gyro,x}$.

The outputs of the blade slope estimator module 540 are output 533, which represents the blade slope angle estimate $\tilde{\alpha}$, and output 531, which represents the blade angular rotation rate estimate $\omega_x$. These values are used in the proportional-and-derivative control algorithm shown in FIG. 5A, as described above.

Details of the Euler angle computation in the sensor pre-processing module 610 are described as follows. The blade frame 220 is generated from the navigation frame 210 (FIG. 2) through successive rotations of angles, referred to as Euler angles and denoted as roll angle $\phi$, pitch angle $\theta$, and yaw angle $\psi$:

(1) Start with the initial navigation frame 210 with ($X_n$, $Y_n$, $Z_n$) axes. Denote this reference frame as $RF_0$ with ($X_0=X_n$, $Y_0=Y_n$, $Z_0=Z_n$) axes.

(2) Rotate $RF_0$ about the $Z_0$-axis through the angle $\psi$. Denote the resulting reference frame as $RF_1$ with ($X_1$, $Y_1$, $Z_1=Z_0$) axes.

(3) Rotate $RF_1$ about the $Y_1$-axis through the angle $\theta$. Denote the resulting reference frame as $RF_2$ with ($X_2$, $Y_2=Y_1$, $Z_2$) axes.

(4) Rotate $RF_2$ about the $X_2$-axis through the angle $\phi$. Denote the resulting reference frame as $RF_3$ with ($X_3=X_2$, $Y_3$, $Z_3$).

Note: In steps (2)-(4), the origin of the reference frames remains fixed at $O_n$ 211 (FIG. 2). The blade frame 220 is generated from $RF_3$ by translating the origin from $O_n$ 211 to $O_b$ 222. Since the PD control algorithms use only the Euler angles, however, the translation can be neglected.

Using these Euler angles, the blade slope angle $\alpha$ and the blade tip angle $\beta$ are computed as follows:

$$\alpha = \operatorname{atan}\left(\frac{\sin(\phi)\cos(\theta)}{\sqrt{\cos^2(\phi)+\sin^2(\phi)\sin^2(\theta)}}\right) \tag{E1}$$

$$\beta = \theta. \tag{E2}$$

During a grading operation, in general, the actual blade slope angle varies from the reference blade slope angle. The values of the blade slope angle and the blade tip angle measured by the tilt sensors and the values of the blade angular rotation rates measured by the three-axis gyroscope in general are functions of time. Measurements from the tilt sensors and the three-axis gyroscope are sampled at specific times. The number of samples per unit time is referred to as the sampling rate; and the time interval between successive samples is referred to as the sampling interval. Typically, the sampling rate of the three-axis gyroscope is greater than the sampling rate of the tilt sensors.

In the sensor pre-processing module 610, the Euler angles are updated every time new measurements (samples) from the three-axis gyroscope 606 are obtained. The Euler angles based on the three-axis gyroscope measurements are computed as follows. First, the initial values of the Euler angles and biases on the rate gyros in the three-axis gyroscope 606 are estimated. For this estimation, the control system requests a certain period of initialization time during which the blade stays motionless. Theoretically, because the blade stays motionless, the three-axis gyroscope 606 should output blade angular rotation rates of zero during this period (ignoring the effect of the Earth's rotation). Because of random noise and bias, however, the measurements are generally noisy and biased. The initial bias estimate on each rate gyro ($\tilde{G}b_{x,0}$ for the $X_b$-axis gyro, $\tilde{G}b_{y,0}$ for the $Y_b$-axis gyro, and $\tilde{G}b_{z,0}$ for the $Z_b$-axis gyro) is estimated by averaging the blade angular rotation rate measurements over this initialization period.

The biases can vary as a function of time. The variation is substantial in MEMS gyroscopes in particular. To improve the accuracy of the blade slope angle estimate, therefore, the current biases are estimated by the sensor processing module 612, as described below.

The initial estimate of the yaw angle ($\psi_{gyro,0}$) can be set to an arbitrary value such as zero because the blade slope angle and the blade tip angle are independent of yaw angle, as shown in (E1) and (E2). The initial estimate of the pitch angle ($\theta_{gyro,0}$) is estimated by averaging the measurements of the blade tip angle tilt sensor 604 over the initialization period. The initial value of the roll angle ($\phi_{gyro,0}$) is then estimated according to the following equation:

$$\phi_{gyro,0} = \operatorname{atan}\left(\frac{\tan(\bar{\alpha})}{\sqrt{\cos^2(\theta_{gyro,0})-\tan^2(\bar{\alpha})\sin^2(\theta_{gyro,0})}}\right), \tag{E3}$$

where $\bar{\alpha}$ is the average of the measurements of the blade slope angle tilt sensor 602 over the initialization period.

Once the initial values of the Euler angles and the gyro biases have been set, the Euler angle estimates are updated by a method using a rotation matrix. The rotation matrix $C_t$ at time t is given as follows with the Euler angle estimates ($\phi_{gt}$, $\theta_{gt}$, $\psi_{gt}$) at time t:

$$C_t = \begin{bmatrix} \cos(\theta_{gt})\cos(\psi_{gt}) & -\cos(\phi_{gt})\sin(\psi_{gt}) + \sin(\phi_{gt})\sin(\theta_{gt})\cos(\psi_{gt}) & \sin(\phi_{gt})\sin(\psi_{gt}) + \cos(\phi_{gt})\sin(\theta_{gt})\cos(\psi_{gt}) \\ \cos(\theta_{gt})\sin(\psi_{gt}) & \cos(\phi_{gt})\cos(\psi_{gt}) + \sin(\phi_{gt})\sin(\theta_{gt})\sin(\psi_{gt}) & -\sin(\phi_{gt})\cos(\psi_{gt}) + \cos(\phi_{gt})\sin(\theta_{gt})\sin(\psi_{gt}) \\ -\sin(\theta_{gt}) & \sin(\phi_{gt})\cos(\theta_{gt}) & \cos(\phi_{gt})\cos(\theta_{gt}) \end{bmatrix}. \quad \text{(E4)}$$

The following compact notation is used: $\rho_{gt}=\rho_{gyro}(t)$, where $\rho_{gt}$ is an estimate of an arbitrary function $\rho$ computed from values of $(\omega_{gyro,x}(t), \omega_{gyro,y}(t), \omega_{gyro,z}(t))$ outputted by the three-axis gyroscope 606 at time t. In compact notation, $(\omega_{gyro,x}(t), \omega_{gyro,y}(t), \omega_{gyro,z}(t))$ are denoted $(\omega_{gxt}, \omega_{gyt}, \omega_{gzt})$.

The measurements $(\omega_{gxt}, \omega_{gyt}, \omega_{gzt})$ are updated by the three-axis gyroscope 606 at discrete time instants $\tau=(\ldots, t-2, t-1, t, t+1, t+2, \ldots)$, where $\tau$ is the system time (for example, referenced to a system clock). These discrete time instants are also referred to as the sampling times of the three-axis gyroscope 606. The time interval between time instants is the sampling interval $\Delta t$. Every time new measurements $(\omega_{gxt}, \omega_{gyt}, \omega_{gzt})$ from the three-axis gyroscope 606 are obtained, the rotation matrix is updated.

The update of the rotation matrix from t to t+1 is calculated as follows:

$$C_{t+1} = C_t A_t \quad \text{(E5)}$$

$$A_t = I + \left(1 - \frac{\sigma^2}{3!}\right)[\sigma\times] + \left(\frac{1}{2} - \frac{\sigma^2}{4!}\right)[\sigma\times]^2, \quad \text{(E6)}$$

where I is the 3×3 identity matrix. $\sigma^2$ and $[\sigma\times]$ are given as follows:

$$\sigma^2 = \{(\omega_{gxt} - \tilde{G}b_{xt})^2 + (\omega_{gyt} - \tilde{G}b_{yt})^2 + (\omega_{gzt} - \tilde{G}b_{zt})^2\}(\Delta t)^2 \quad \text{(E7)}$$

$$[\sigma\times] = \begin{bmatrix} 0 & -(\omega_{gzt} - \tilde{G}b_{zt}) & (\omega_{gyt} - \tilde{G}b_{yt}) \\ (\omega_{gzt} - \tilde{G}b_{zt}) & 0 & -(\omega_{gxt} - \tilde{G}b_{xt}) \\ -(\omega_{gyt} - \tilde{G}b_{yt}) & (\omega_{gxt} - \tilde{G}b_{xt}) & 0 \end{bmatrix}\Delta t. \quad \text{(E8)}$$

Then, new Euler angles are computed from the new rotation matrix as follows:

$$\phi_{gyro} = \operatorname{atan}\left(\frac{c_{32}}{c_{33}}\right) \quad \text{(E9)}$$

$$\theta_{gyro} = \operatorname{asin}(-c_{31})$$

$$\psi_{gyro} = \operatorname{atan}\left(\frac{c_{21}}{c_{11}}\right),$$

where $c_{ij}$ represents the (i, j) element in the rotation matrix.

After updating the Euler angles, the sensor pre-processing module 610 outputs the computed roll angle estimate $\phi_{gyro}$ and the computed pitch angle estimate $\theta_{gyro}$. From these two values, as shown below, the blade slope angle estimate $\tilde{\alpha}$ can be computed. In principle, the accuracy of the blade slope angle estimate $\tilde{\alpha}$ can be improved by fusing the computed roll angle estimate $\phi_{gyro}$ and the computed pitch angle estimate $\theta_{gyro}$ with the blade slope angle $\alpha_{tilt}$ measured by the blade slope angle tilt sensor 602 and the blade tip angle $\beta_{tilt}$ measured by the blade tip angle tilt sensor 604 (as shown below). In practice, however, fusion of the data is not straightforward because the sensors are not synchronized and because tilt sensors are not accurate during strong dynamic motion. These factors are discussed below.

In general, the sampling rate of a three-axis gyroscope is higher than the sampling rate of a tilt sensor. Furthermore, in general, the three-axis gyroscope 606, the blade slope angle tilt sensor 602, and the blade tip angle tilt sensor 604 are not synchronized. If data from the three-axis gyroscope 606 is fused with out-of-date data from the blade slope angle tilt sensor 602 or the blade tip angle tilt sensor 604, resulting estimates can have large errors.

As discussed above, tilt sensors are vulnerable to high dynamic motions, whereas three-axis gyroscopes are relatively immune to high dynamic motions. If data from the three-axis gyroscope 606 is fused with inaccurate data from the blade slope angle tilt sensor 602 or the blade tip angle tilt sensor 604, resulting estimates can have large errors.

Sensor fusion (the fusion of data from multiple sensors) can be performed by various filters. As discussed above, the blade slope angle estimate $\tilde{\alpha}$ is computed from the computed roll angle estimate $\phi_{gyro}$ and the computed pitch angle estimate $\theta_{gyro}$. Therefore, the accuracy of the blade slope angle estimate is dependent on the accuracy of $\phi_{gyro}$ and $\theta_{gyro}$. The accuracy of $\phi_{gyro}$ and the accuracy of $\theta_{gyro}$ are dependent on the accuracy of the gyro bias estimates. Furthermore, the accuracy of the blade angular rotation rate estimate $\tilde{\omega}_x$ is dependent on the accuracy of the gyro bias estimate $\tilde{G}b_x$. To obtain an accurate blade slope angle estimate and an accurate blade angular rotation rate estimate, therefore, the sensor fusion should provide accurate corrections on all of the computed roll angle estimate $\phi_{gyro}$, the computed pitch angle estimate $\theta_{gyro}$, the $X_b$-axis gyro bias estimate, and the $Y_b$-axis gyro bias estimate.

There are two available observations for the sensor fusion filter: the blade slope angle $\alpha_{tilt}$ and the blade tip angle $\beta_{tilt}$ measured by the blade slope angle tilt sensor and the blade tip angle tilt sensor, respectively. On the other hand, there are four parameters which should be estimated by the filter: the corrections on the computed roll angle estimate, the computed pitch angle estimate, the $X_b$-axis gyro bias estimate, and the $Y_b$-axis gyro bias estimate. Therefore, the filter should work on single or multiple dynamic system models that relate the errors on the roll angle, the pitch angle, the $X_b$-axis gyro bias, and the $Y_b$-axis gyro bias with the blade slope angle and the blade tip angle. Kalman filters or particle filters are examples of suitable filters which are designed based on a dynamic system model.

Figure 7A:
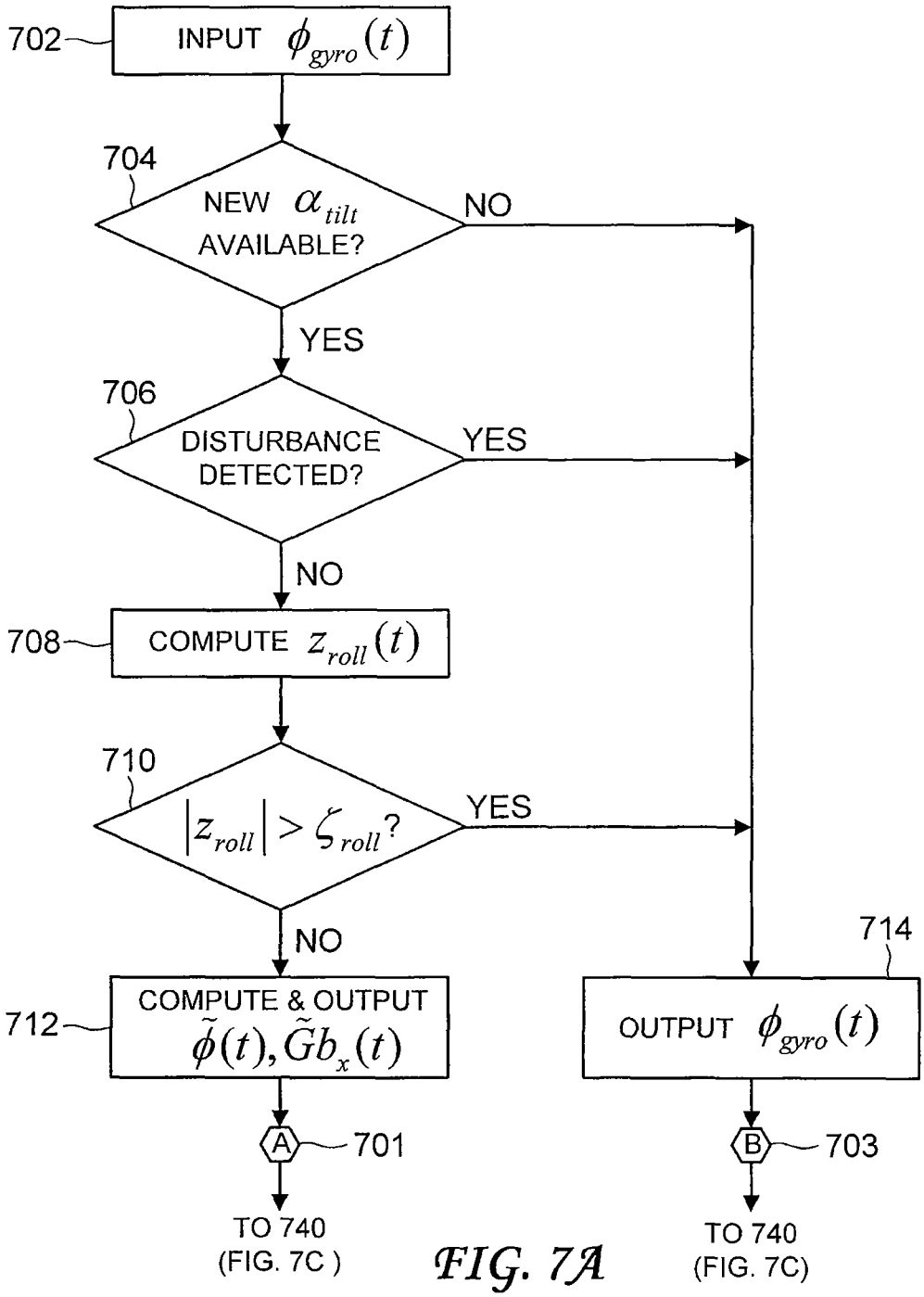
FIG. 7A-FIG. 7C show flowcharts of a method for sensor processing.
Figure 7B:
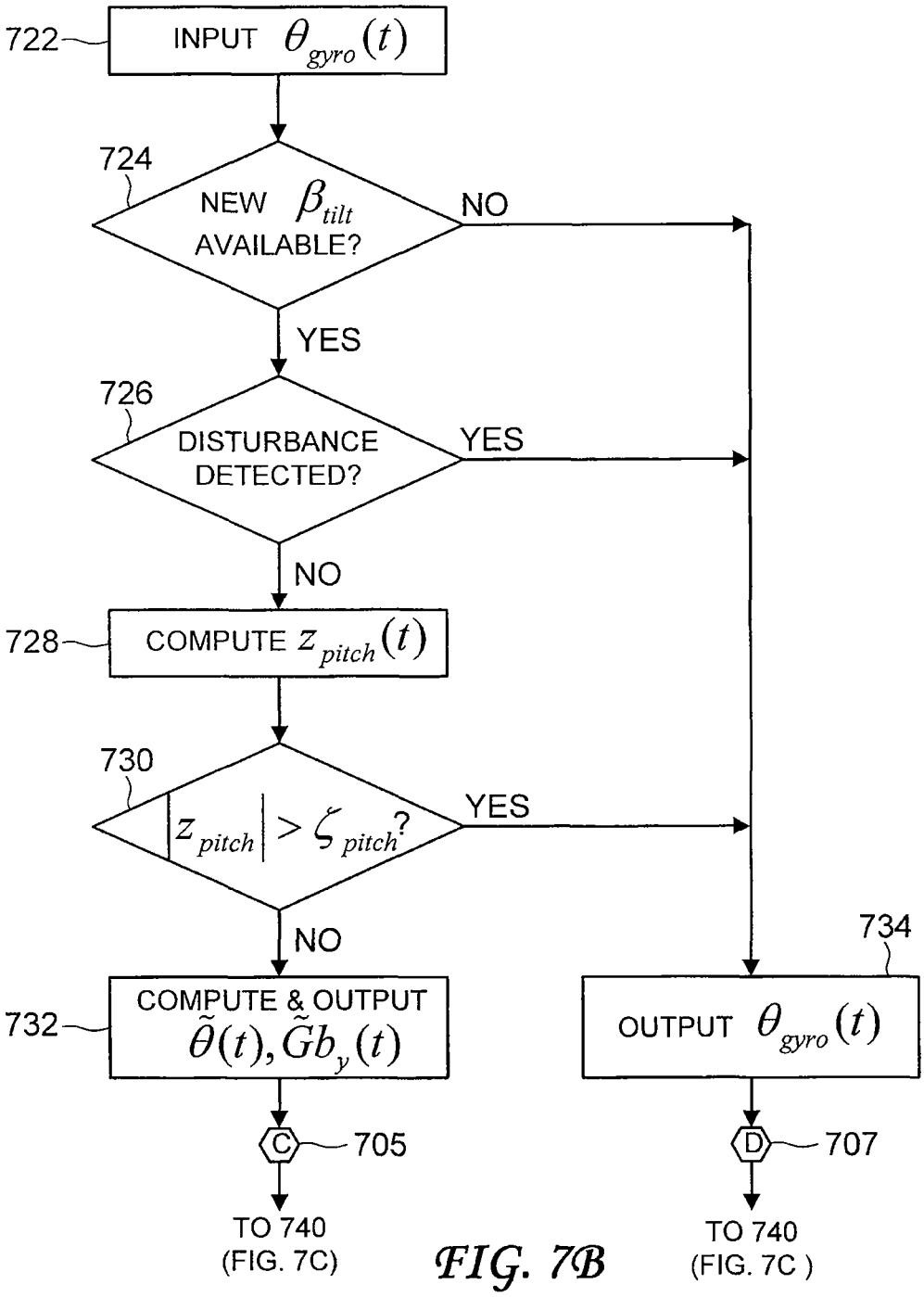
Figure 7C:
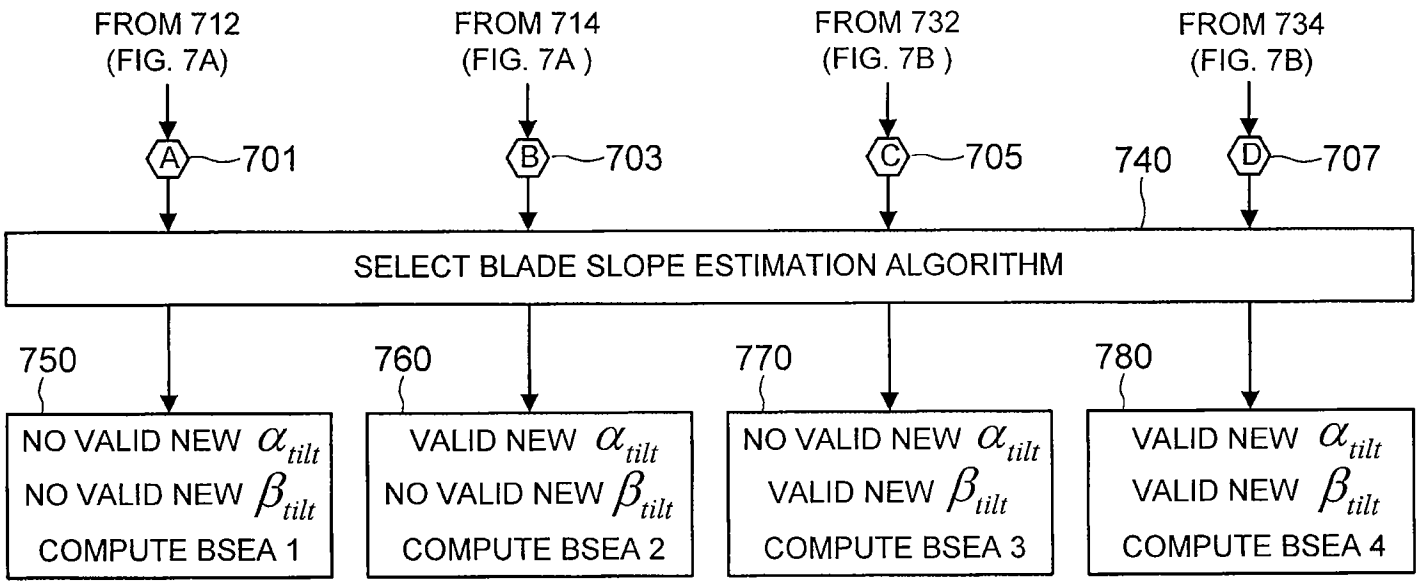

FIG. 7A-FIG. 7C show a flowchart of an algorithm, according to an embodiment, performed by the sensor processing module 612. Reference marks shown as an alphabetical character inside a hexagon are used to maintain continuity among FIG. 7A-FIG. 7C. The reference marks are reference mark A 701, reference mark B 703, reference mark C 705, and reference mark D 707. The reference marks are shown in the figures as visual aids but are not explicitly included in the description below.

Refer to FIG. 7A. In step 702, the computed roll angle estimate $\phi_{gyro}(t)$ is inputted from the sensor pre-processing module 610. The process then passes to step 704, in which the availability of a new value of $\alpha_{tilt}$ from the blade slope angle tilt sensor 602 is determined. The value of $\phi_{gyro}(t)$ arrives at the sensor processing module 612 at $\tau_t=t\ \delta_{spp}$, where $\delta_{spp}$ is the processing delay for the sensor pre-processing module 610. The previous value of $\phi_{gyro}(t-1)$ had arrived at the sensor processing module 612 at $\tau_{t-1}=(t-1)+\delta_{spp}$. If a value of $\alpha_{tilt}$ arrives at a time $\tau_\alpha$ such that $\tau_{t-1}<\tau_\alpha\leq\tau_t$, then a new value of $\alpha_{tilt}$ is available. To simplify the notation, the new value of $\alpha_{tilt}$ is denoted $\alpha_{tilt}(t)$ when the time dependence is explicitly called out. A similar notation holds for a new value of $\beta_{tilt}$, as discussed below.

In step 704, if a new value of $\alpha_{tilt}$ is not available, then the process passes to step 714 in which the value of $\phi_{gyro}(t)$ is outputted to step 740 in FIG. 7C. If a new value of $\alpha_{tilt}$ is available, then the process passes to step 706 in which the occurrence of a disturbance is determined. As discussed above, the measurement of a tilt sensor can be corrupted by disturbances such as sudden movements of the blade (including sudden movements of the entire motor grader).

Various criteria can be used to determine when a disturbance sufficiently high to yield an invalid measurement from a tilt sensor has occurred. In one embodiment, a disturbance is detected if $|\alpha_{tilt}(\tau_\alpha^n)-\alpha_{tilt}(\tau_\alpha^p)|>\Delta\alpha_{tilt,max}$, where $\alpha_{tilt}(\tau_\alpha^n)$ is the new value of $\alpha_{tilt}$, $\alpha_{tilt}(\tau_\alpha^p)$ is the previous value of $\alpha_{tilt}$, and $\Delta\alpha_{tilt,max}$ is a user-defined threshold value. Under normal operation, variations in $\alpha_{tilt}$ are expected to fall within a particular range. If the change in $\alpha_{tilt}$ from one measurement to the next is unexpectedly large, then the new measurement of $\alpha_{tilt}$ is suspect.

In another embodiment, a disturbance is detected if $|\omega_{gyro,z}(t)|>\Omega_{gyro,z}$, where $\Omega_{gyro,z}$ is a user-defined threshold value. An excessively high value of $|\omega_{gyro,z}(t)|$ can result, for example, if the blade turns sharply or spins. In FIG. 6A, input of $\omega_{gyro,z}$ into the sensor processing module 612 is not explicitly shown. The value of $\omega_{gyro,z}$ can be inputted from the three-axis axis gyroscope 606 or passed through the sensor pre-processing module 610.

Note that logical combinations of different criteria can be used for determining a disturbance. As one example, a disturbance is detected if $|\alpha_{tilt}(\tau_\alpha^n)-\alpha_{tilt}(\tau_\alpha^p)|>\Delta\alpha_{tilt,max}$ OR $|\omega_{gyro,z}(t)|>\omega_{gyro,z}$.

In step 706, if a disturbance is detected, then the new value of $\alpha_{tilt}$ is discarded, and the process passes to step 714, in which the value of $\phi_{gyro}(t)$ is outputted to step 740 in FIG. 7C. If a disturbance is not detected, then the new value of $\alpha_{tilt}$ is accepted, and the process passes to step 708, in which $Z_{roll}(t)$, the Kalman filter measurement at time t, is computed. Details of step 708 are described below. The process then passes to step 710, in which an additional disturbance determination is performed. If $|Z_{roll}(t)|>f_{roll}$, where $f_{roll}$ is a user-defined threshold value, then a disturbance is detected. In the embodiment shown in FIG. 7A, the disturbance detection in step 710 is performed in addition to the disturbance detection in step 706. In a second embodiment, step 706 is omitted, and only step 708 and step 710 are performed for disturbance detection. In a third embodiment, step 708 and step 710 are omitted, and only step 706 is performed for disturbance detection.

In step 710, if a disturbance is detected, then the new value of $\alpha_{tilt}$ is declared to be invalid, and the process passes to step 714, in which the value of $\phi_{gyro}(t)$ is outputted to step 740 in FIG. 7C. If a disturbance is not detected, then the new value of $\alpha_{tilt}$ is declared to be valid, and the process passes to step 712. The corrected estimates, $\tilde{\phi}(t)$ and $\tilde{G}b_x(t)$, are computed and outputted to step 740 in FIG. 7C. Details of step 712 are discussed below.

Refer to FIG. 7B. The flowchart in FIG. 7B is similar to the flowchart in FIG. 7A, except that the pitch angle estimate is processed instead of the roll angle estimate. In step 722, the computed pitch angle estimate $\theta_{gyro}(t)$ is inputted from the sensor pre-processing module 610. The process then passes to step 724, in which the availability of a new value of $\beta_{tilt}$ from the blade tip angle tilt sensor 604 is determined. The criteria for the availability of a new value of $\beta_{tilt}$ is similar to the criteria discussed above for the availability of a new value of $\alpha_{tilt}$. If a new value of $\beta_{tilt}$ is not available, then the process passes to step 734, in which the value of $\theta_{gyro}(t)$ is outputted to step 740 in FIG. 7C.

If a new value of $\beta_{tilt}$ is available, then the process passes to step 726, in which the occurrence of a disturbance is determined. The criteria for detecting a disturbance in measurements of $\beta_{tilt}$ are similar to the criteria discussed above for detecting a disturbance in measurements of $\alpha_{tilt}$.

In step 726, if a disturbance is detected, then the new value of $\beta_{tilt}$ is discarded, and the process passes to step 734, in which the value of $\theta_{gyro}(t)$ is outputted to step 740 in FIG. 7C. If a disturbance is not detected, then the new value of $\beta_{tilt}$ is accepted, and the process passes to step 728, in which $Z_{pitch}(t)$, the Kalman filter measurement at time t, is computed. Details of step 728 are described below. The process then passes to step 730, in which an additional disturbance detection is performed. If $|Z_{pitch}(t)|>\zeta_{pitch}$, where $\zeta_{pitch}$ is a user-defined threshold value, then a disturbance is detected. In the embodiment shown in FIG. 7B, the disturbance detection in step 730 is performed in addition to the disturbance detection in step 726. In a second embodiment, step 726 is omitted, and only step 728 and step 730 are performed for disturbance detection. In a third embodiment, step 728 and step 730 are omitted, and only step 726 is performed for disturbance detection.

In step 730, if a disturbance is detected, then the new value of $\beta_{tilt}$ is declared to be invalid, and the process passes to step 734, in which the value of $\theta_{gyro}(t)$ is outputted to step 740 in FIG. 7C. If a disturbance is not detected, then the new value of $\beta_{tilt}$ is declared to be valid, and the process passes to step 732. The corrected estimates, $\tilde{\theta}(t)$ and $\tilde{G}b_y(t)$, are computed and outputted to step 740 in FIG. 7C. Details of step 732 are discussed below.

Refer to FIG. 7C. In step 740, a blade slope estimation algorithm (BSEA) is selected. The choice of BSEA depends on whether a valid new value of $\alpha_{tilt}$ is available (FIG. 7A) and on whether a valid new value of $\beta_{tilt}$ is available (FIG. 7B). There are four possible selections:

- Step 750: Compute BSEA 1 (valid new value of $\alpha_{tilt}$ not available, valid new value of $\beta_{tilt}$ not available)
- Step 760: Compute BSEA 2 (valid new value of $\alpha_{tilt}$ available, valid new value of $\beta_{tilt}$ not available)
- Step 770: Compute BSEA 3 (valid new value of $\alpha_{tilt}$ not available, valid new value of $\beta_{tilt}$ available)
- Step 780: Compute BSEA 4 (valid new value of $\alpha_{tilt}$ available, valid new value of $\beta_{tilt}$ available).

The individual BSEAs are first summarized below. Details of the algorithms for computing the corrected estimates $\tilde{\phi}(t)$, $\tilde{\theta}(t)$, $\tilde{G}b_x(t)$, and $\tilde{G}b_y(t)$ are discussed afterwards.

In BSEA 1, a valid new value of $\alpha_{tilt}$ is not available, and a valid new value of $\beta_{tilt}$ is not available. No sensor fusion is performed. The blade slope angle estimate $\tilde{\alpha}(t)$ is computed from $\phi_{gyro}(t)$ and $\theta_{gyro}(t)$:

$$\tilde{\alpha}(t) = \operatorname{atan}\left(\frac{\sin(\phi_{gyro}(t))\cos(\theta_{gyro}(t))}{\sqrt{\cos^2(\phi_{gyro}(t)) + \sin^2(\phi_{gyro}(t))\sin^2(\theta_{gyro}(t))}}\right). \quad \text{(E10)}$$

No corrected values of parameters are fed back to the sensor pre-processing module 610. No corrected value of the $X_b$-axis gyro bias estimate is inputted into the gyro bias calibration module 614. Since no corrected value of the $X_b$-axis gyro bias estimate is inputted into the gyro bias calibration module 614, the gyro bias calibration module 614 computes the $X_b$-axis blade angular rotation rate estimate $\tilde{\omega}_x(t)$ from $\omega_{gyro,x}(t)$ and the previous value of the $X_b$-axis gyro bias estimate, denoted $\tilde{G}b_x(t-1)$:

$$\tilde{\omega}(t)=\omega_{gyro,x}(t)-\tilde{G}b_x(t-1). \tag{E11}$$

Note that $\tilde{G}b_x(t-1)=Gb_{x,0}$ if the $X_b$-axis gyro bias estimate has not been previously corrected.

In BSEA 2, a valid new value of $\alpha_{tilt}$ is available, and a valid new value of $\beta_{tilt}$ is not available. Sensor fusion of $\phi_{gyro}$, $\theta_{gyro}$, and $\alpha_{tilt}$ is performed. A corrected estimate of the roll angle, denoted $\tilde{\phi}(t)$, is computed (details are discussed below). A corrected estimate of the $X_b$-axis gyro bias estimate, denoted $\tilde{G}b_x(t)$, is computed (details are discussed below). The corrected estimates $\tilde{\phi}(t)$ and $\tilde{G}b_x(t)$ are fed back to the sensor pre-processing module 610. The blade slope angle estimate $\tilde{\alpha}(t)$ is computed from $\tilde{\phi}(t)$ and $\theta_{gyro}(t)$:

$$\tilde{\alpha}(t) = \operatorname{atan}\left(\frac{\sin(\tilde{\phi}(t))\cos(\theta_{gyro}(t))}{\sqrt{\cos^2(\tilde{\phi}(t)) + \sin^2(\tilde{\phi}(t))\sin^2(\theta_{gyro}(t))}}\right). \tag{E12}$$

The corrected estimate $\tilde{G}b_x(t)$ is inputted to the gyro bias calibration module 614. The $X_b$-axis blade angular rotation rate estimate $\tilde{\omega}_x(t)$ is computed from $\omega_{gyro,x}(t)$ and $\tilde{G}b_x(t)$:

$$\tilde{\omega}(t)=\omega_{gyro,x}(t)-\tilde{G}b_x(t). \tag{E13}$$

In BSEA 3, a valid new value of $\alpha_{tilt}$ is not available, and a valid new value of $\beta_{tilt}$ is available. Sensor fusion of $\phi_{gyro}$, $\theta_{gyro}$, and $\beta_{tilt}$ is performed. A corrected estimate of the pitch angle, denoted $\tilde{\theta}(t)$, is computed (details are discussed below). A corrected estimate of the $Y_b$-axis gyro bias estimate, denoted $\tilde{G}b_y(t)$, is computed (details are discussed below). The corrected estimates $\tilde{\theta}(t)$ and $\tilde{G}b_y(t)$ are fed back to the sensor pre-processing module 610. The blade slope angle estimate $\tilde{\alpha}(t)$ is computed from $\phi_{gyro}(t)$ and $\tilde{\theta}(t)$:

$$\tilde{\alpha}(t) = \operatorname{atan}\left(\frac{\sin(\phi_{gyro}(t))\cos(\tilde{\theta}(t))}{\sqrt{\cos^2(\phi_{gyro}(t)) + \sin^2(\phi_{gyro}(t))\sin^2(\tilde{\theta}(t))}}\right). \tag{E14}$$

No corrected value of the $X_b$-axis gyro bias estimate is inputted into the gyro bias calibration module 614. The $X_b$-axis blade angular rotation rate estimate $\tilde{\omega}_x(t)$ is computed from $\omega_{gyro,x}(t)$ and $\tilde{G}b_x(t-1)$:

$$\tilde{\omega}(t)=\omega_{gyro,x}(t)-\tilde{G}b_x(t-1). \tag{E15}$$

In BSEA 4, a valid new value of $\alpha_{tilt}$ is available, and a valid new value of $\beta_{tilt}$ is available. Sensor fusion of $\phi_{gyro}$, $\theta_{gyro}$, $\alpha_{tilt}$, and $\beta_{tilt}$ is performed. The corrected estimates $\tilde{\phi}(t)$, $\tilde{\theta}(t)$, $\tilde{G}b_x(t)$, and $\tilde{G}b_y(t)$ are computed. The corrected estimates $\tilde{\phi}(t)$, $\tilde{\theta}(t)$, $\tilde{G}b_x(t)$, and $\tilde{G}b_y(t)$ are fed back to the sensor pre-processing module 610. The blade slope angle estimate $\tilde{\alpha}(t)$ is computed from $\tilde{\phi}(t)$ and $\tilde{\theta}(t)$:

$$\tilde{\alpha}(t) = \operatorname{atan}\left(\frac{\sin(\tilde{\phi}(t))\cos(\tilde{\theta}(t))}{\sqrt{\cos^2(\tilde{\phi}(t)) + \sin^2(\tilde{\phi}(t))\sin^2(\tilde{\theta}(t))}}\right). \tag{E16}$$

The corrected estimate $\tilde{G}b_x(t)$ is inputted into the gyro bias calibration module 614. The $X_b$-axis blade angular rotation rate estimate $\tilde{\omega}_x(t)$ is computed from $\omega_{gyro,x}(t)$ and $\tilde{G}b_x(t)$:

$$\tilde{\phi}(t)=\omega_{gyro,x}(t)-\tilde{G}b_x(t). \tag{E17}$$

As discussed above, computation of the current values of $\phi_{gyro}(t)$ and $\theta_{gyro}(t)$ in the sensor pre-processing module 610 uses the previous value of the roll angle, the previous value of the pitch angle, the value of the roll angle bias estimate, and the value of the pitch angle bias estimate. The accuracy of computing the next values of $\phi_{gyro}(t+1)$ and $\theta_{gyro}(t+1)$ can be improved by using the corrected estimates $\tilde{\phi}(t)$, $\tilde{\theta}(t)$, $\tilde{G}b_x(t)$, and $\tilde{G}b_y(t)$ instead of $\phi_{gyro}(t)$, $\theta_{gyro}(t)$, $\tilde{G}b_x(t-1)$, and $\tilde{G}b_y(t-1)$. Therefore, the sensor processing module 612 feeds back values of the corrected estimates $\tilde{\phi}(t)$, $\tilde{\theta}(t)$, $\tilde{G}b_x(t)$, and $\tilde{G}b_y(t)$, when they are available, to the sensor pre-processing module 610.

In an embodiment, the sensor processing module 612 uses two extended Kalman filters (EKFs) for fusing sensor data. The first EKF computes the corrected roll angle estimate and the corrected roll angle bias estimate (corrected $X_b$-axis gyro bias estimate). The second EKF computes the corrected pitch angle estimate and the corrected pitch angle bias estimate (corrected $Y_b$-axis gyro bias estimate).

The details of the EKF for the roll angle and roll angle bias estimates are as follows. The state vector $x_{roll}$ of the EKF includes the roll angle error $\Delta\phi$ and the $X_b$-axis gyro bias error $\Delta Gb_x$:

$$x_{roll} = \begin{bmatrix} \Delta\phi \\ \Delta Gb_x \end{bmatrix}. \tag{E18}$$

For this state vector, a state propagation model can be given as follows:

$$x_{roll}(t+1) = \begin{bmatrix} 1 & dt \\ 0 & 1 \end{bmatrix} x_{roll}(t) + w_{roll}(t), \tag{E19}$$

where $w_{roll}(t)$ is a 2×1 system noise vector at time t in which the first element represents the noise on the roll angle, and the second element represents the noise on the roll angular rotation rate.

With the state vector $x_{roll}(t)$ and the tilt sensor measurements $\alpha_{tilt}(t)$, an observation model is formed as follows:

$$z_{roll}(t)=[10]X_{roll}(t)+R_{roll}(t), \tag{E20}$$

where $R_{roll}(t)$ is the measurement noise on the blade slope angle tilt sensor 602. $Z_{roll}(t)$, the Kalman filter measurement at time t, is computed with the following equation using the computed roll angle estimate $\phi_{gyro}$ and the computed pitch angle estimate $\theta_{gyro}$ computed in the sensor pre-processing module 610 and the blade slope angle $\alpha_{tilt}$ measured by the blade slope angle tilt sensor 602:

$$z_{roll}(t) = \operatorname{atan}\left(\frac{\sin(\phi_{gyro}(t))\cos(\theta_{gyro}(t))}{\sqrt{\cos^2(\phi_{gyro}(t)) + \sin^2(\phi_{gyro}(t))\sin^2(\theta_{gyro}(t))}}\right) - \alpha_{tilt}(t). \tag{E21}$$

Representing these models in a general form of Kalman filter, an EKF that estimates the roll angle error $\Delta\phi$ and the $X_b$-axis gyro bias error $\Delta Gb_x$ using tilt sensor measurements can be realized.

With the state vector estimated in the EKF, the roll angle and the $X_b$-axis gyro bias are corrected as follows:

$$\tilde{\phi}(t)=\phi_{gyro}(t)-\Delta\phi(t) \tag{E22}$$

$$\tilde{G}b_x(t)=\tilde{G}b_x(t-1)+\Delta Gb_x(t). \tag{E23}$$

In the same manner, the models for the EKF for the pitch angle can be derived. The state vector ($x_{pitch}$) for this EKF includes the pitch angle error $\Delta\theta$ and the $Y_b$-axis gyro bias error $\Delta Gb_y$. The state propagation model is then given as follows:

$$x_{pitch}(t+1) = \begin{bmatrix} 1 & dt \\ 0 & 1 \end{bmatrix} x_{pitch}(t) + w_{pitch}(t), \tag{E24}$$

where $w_{pitch}(t)$ is a 2×1 system noise vector at time t in which the first element represents the noise on the pitch angle, and the second element represents the noise on the pitch angular rotation rate. With the blade tip angle tilt sensor measurement ($\beta_{tilt}$), the observation model is formed as follows:

$$z_{pitch}(t)=[10]x_{pitch}(t)+R_{pitch}(t), \tag{E25}$$

where $R_{pitch}(t)$ is the measurement noise on the blade tip angle tilt sensor 604. $z_{pitch}(t)$, the Kalman filter measurement at time t, is computed with the following equation using the computed pitch angle estimate $\theta_{gyro}$ computed in the sensor pre-processing module 610 and the blade tip angle $\beta_{tilt}$ measured by the blade tip angle tilt sensor 604:

$$z_{pitch}(t)=\theta_{gyro}(t)-\beta_{tilt}(t). \tag{E26}$$

Representing these models in a general form of Kalman filter, an EKF that estimates the pitch angle error $\Delta\theta$ and the $Y_b$-axis gyro bias error $\Delta Gb_y$ using tilt sensor measurements can be realized.

With the state vector estimated in the EKF, the pitch angle and the $Y_b$-axis gyro bias are corrected as follows:

$$\tilde{\theta}(t)=\theta_{gyro}(t)-\Delta\theta(t) \tag{E27}$$

$$\tilde{G}b_y(t)=\tilde{G}b_y(t-1)+\Delta Gb_y(t). \tag{E28}$$

In the embodiment described above, the blade attitude is represented by Euler angles. In another embodiment, the blade attitude is represented by a quaternion. In contrast with Euler angles, the quaternion is a four-parameter attitude representation with which the coordinate system of the navigation frame 210 can be transformed to the coordinate system of the blade frame 220 (FIG. 2). The quaternion at the current time instant can be propagated to the quaternion at the next time instant by the using the measurements ($\omega_{gyro,x}$, $\omega_{gyro,y}$, $\omega_{gyro,z}$) from the three-axis gyroscope 606 (see FIG. 6A). Attitude representation by a quaternion and the propagation method using gyroscope measurements are well known in the art. One skilled in the art can design embodiments of a sensor pre-processing module and a sensor processing module for a quaternion similar to those described above for Euler angles.

In the embodiments described above, the coordinate system of the navigation frame 210 is transformed to the coordinate system of the blade frame 220 via Euler angles or a quaternion. In other embodiments, the coordinate system of the blade frame 220 is transformed to the coordinate system of the navigation frame 210 via Euler angles or a quaternion.

Figure 5B:
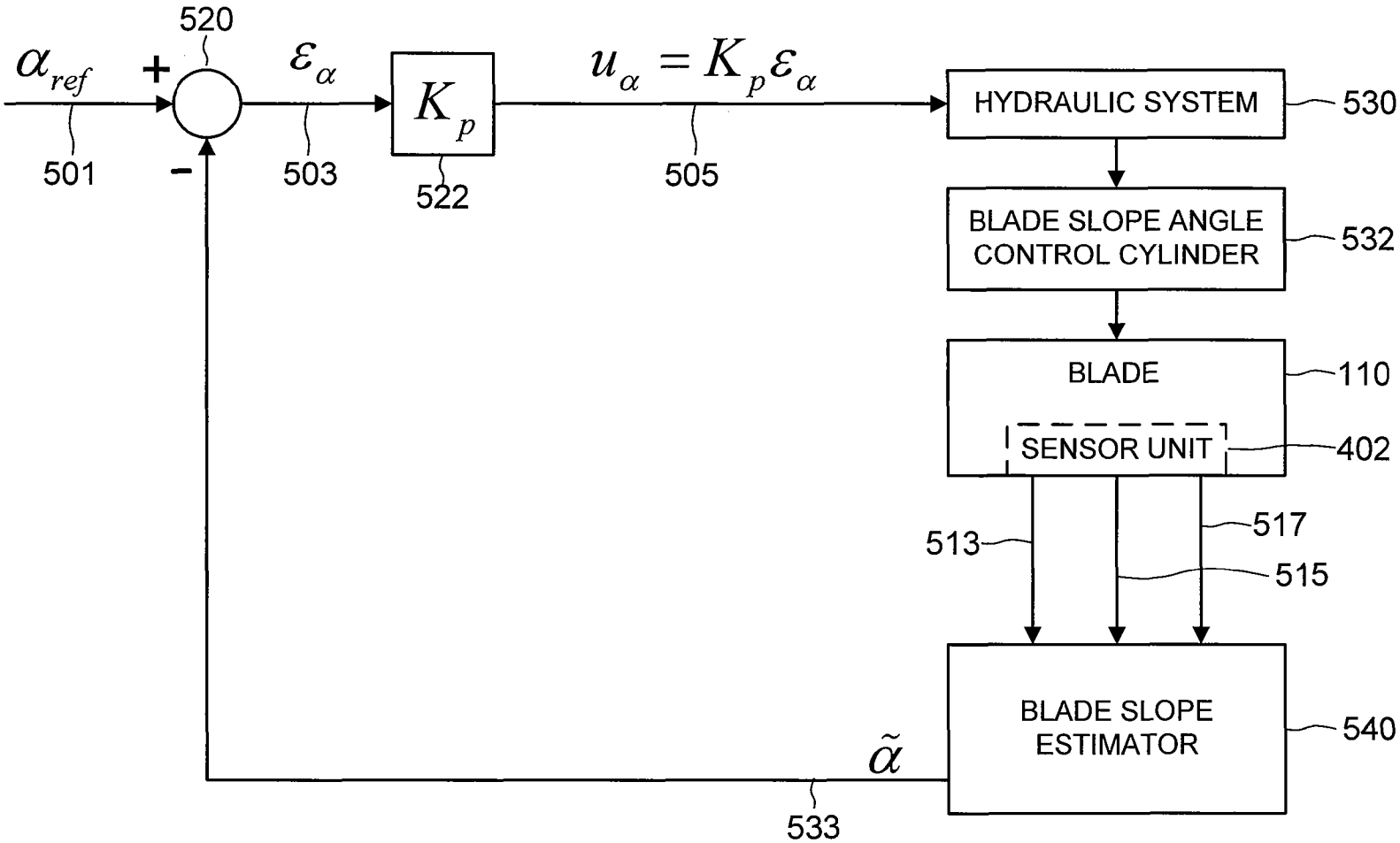
FIG. 5B shows a schematic of a proportional control algorithm for automatic blade slope control.
Figure 6B:
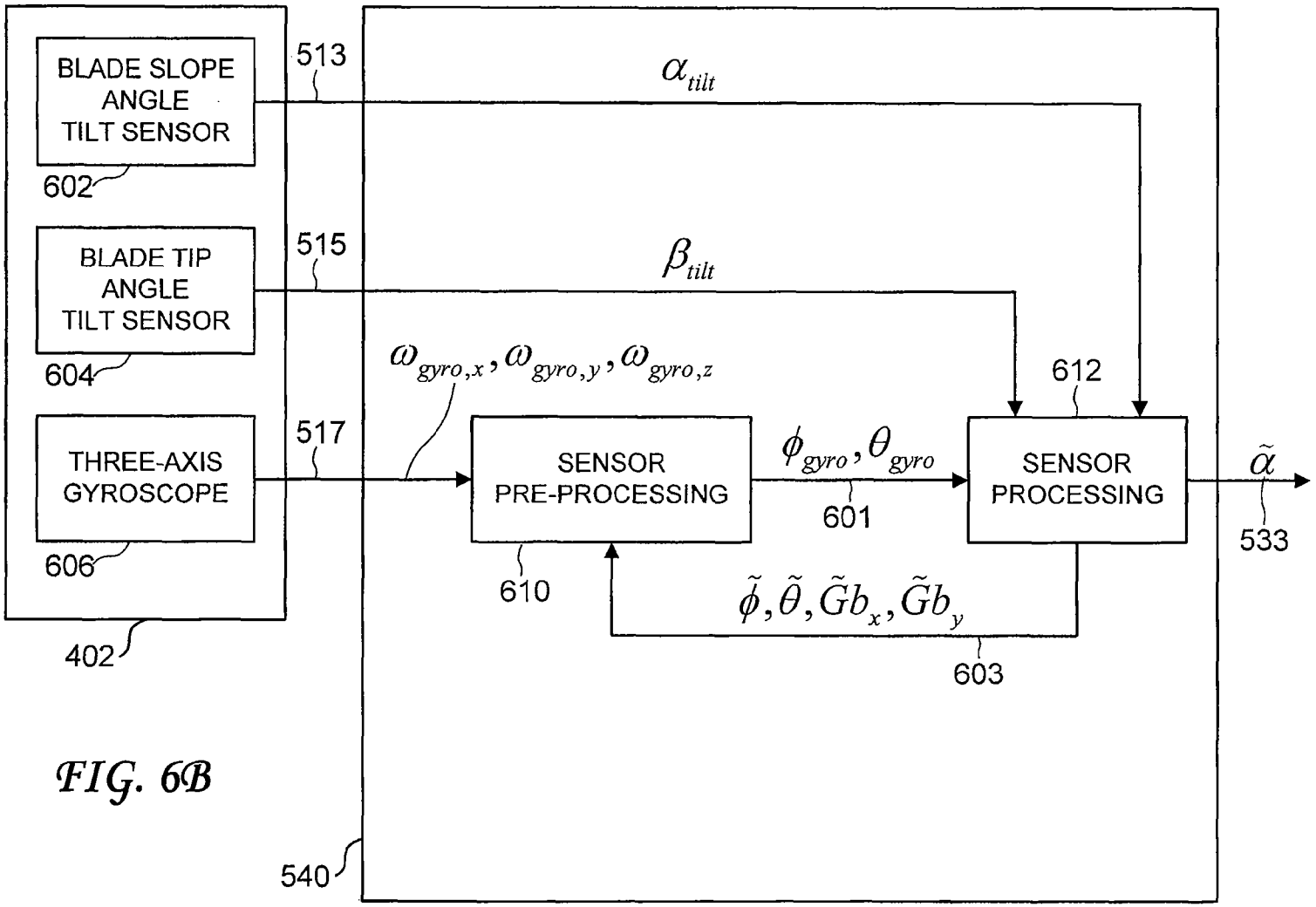
FIG. 6B shows a schematic of a blade slope estimator module for a proportional control algorithm.

FIG. 5A and FIG. 6A show a schematic of a proportional-and-derivative control algorithm. For some applications, a proportional control algorithm can be used. For example, if the specifications for the finished graded surface are not too strict, a less complex and lower cost automatic blade slope control system can be used. FIG. 5B and FIG. 6B show a schematic of a proportional control algorithm. As shown in FIG. 5B, for a proportional control algorithm, the derivative loop in FIG. 5A (operation 526 and operation 524) are omitted. The control signal $u_\alpha$ is then equal to the product $K_p\epsilon_\alpha$ 505. In FIG. 6B, the gyro bias calibration module 614 is omitted, since the $X_b$-axis blade angular rotation rate estimate $\tilde{\omega}_x$ 531 is not needed for the proportional control algorithm.

Since the automatic blade slope control system described herein is independent of blade elevation, the automatic blade slope control system can be added to existing motor graders without replacing or modifying the existing elevation control systems. Although the motor grader 100 (FIG. 1A and FIG. 1B) was used as a specific example of an earthmoving machine, embodiments of the automatic blade slope control system described herein can be used for other earthmoving machines, such as bulldozers. In general, one skilled in the art can develop embodiments of the automatic blade slope control system described herein for automatic slope control of an implement mounted on a vehicle, wherein the attitude of the implement with respect to a local reference plane can be specified by an implement slope angle and an implement tip angle. For example, embodiments of the automatic blade slope control system described herein can be used for automatic slope control of a screed on a paver. In general, herein, the term "blade" refers to a blade or a blade-like implement such as a screed.

In FIG. 5A, the control signal $u_\alpha$ 507 is inputted into the hydraulic system 530, which controls the displacement of the blade slope angle control cylinder 532. As discussed above, the hydraulic system 530 can also control the blade slope angle by controlling the displacement of two hydraulic control cylinders (the right lift cylinder 112 and the left lift cylinder 114 shown in FIG. 1A and FIG. 1B). One skilled in the art can develop embodiments of the automatic blade slope control system for other drive systems. For example, control signal $u_\alpha$ 507 can be inputted into an electronic control system driving an electric motor which in turn drives a gear, screw, piston, or driveshaft via an appropriate coupling. In general, the control signal $u_\alpha$ 507 is inputted into a blade slope angle drive system, which controls a blade slope angle control driver operatively coupled to the blade 110. A driver is also referred to as an actuator.

Figure 8:
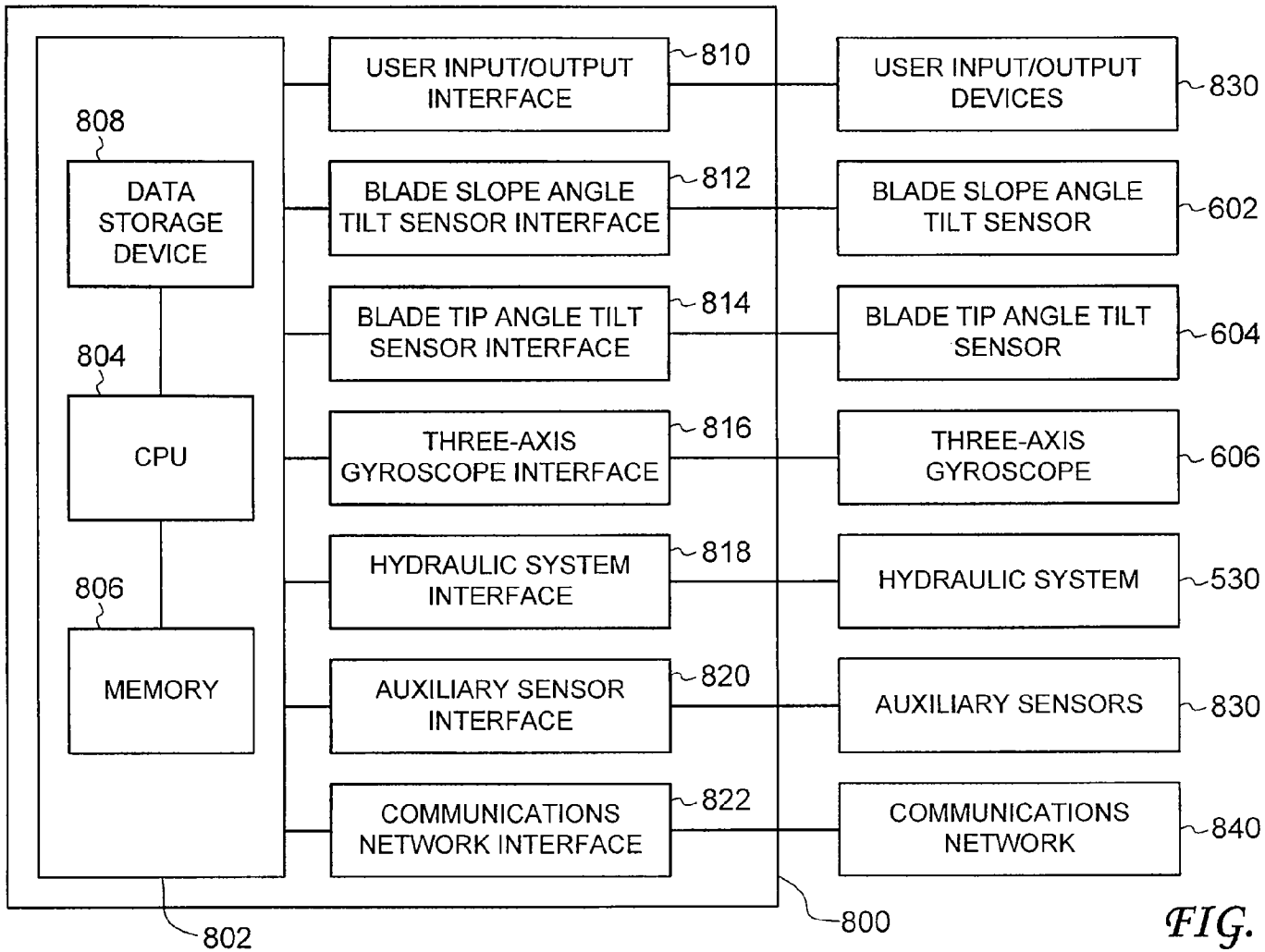
FIG. 8 shows a schematic of a computational system for implementing an automatic blade slope control system.

An embodiment of a computational system 800 for implementing an automatic blade slope angle control system is shown in FIG. 8. The computational system 800, for example, can be installed in the cabin 104 of the motor grader 100 (FIG. 1A and FIG. 1B). One skilled in the art can construct the computational system 800 from various combinations of hardware, firmware, and software. One skilled in the art can construct the computational system 800 from various electronic components, including one or more general purpose microprocessors, one or more digital signal processors, one or more application-specific integrated circuits (ASICs), and one or more field-programmable gate arrays (FPGAs).

The computational system 800 includes a computer 802, which includes a central processing unit (CPU) 804, memory 806, and a data storage device 808. The data storage device 808 includes at least one persistent, non-transitory, tangible computer readable medium, such as non-volatile semiconductor memory, a magnetic hard drive, or a compact disc read only memory.

The computational system 800 can further include a user input/output interface 810, which interfaces computer 802 to user input/output devices 830. Examples of user input/output devices 830 include a keyboard, a mouse, a local access terminal, and a video display. Data, including computer executable code, can be transferred to and from the computer 802 via the user input/output interface 810.

The computational system 800 can further include a communications network interface 822, which interfaces the computer 802 with a communications network 840. Examples of the communications network 840 include a local area network and a wide area network. A user can access the computer 802 via a remote access terminal (not shown) communicating with the communications network 840. Data, including computer executable code, can be transferred to and from the computer 802 via the communications network interface 822.

The computational system 800 can further include a blade slope angle tilt sensor interface 812, which interfaces the computer 802 with the blade slope angle tilt sensor 602.

The computational system 800 can further include a blade tip angle tilt sensor interface 814, which interfaces the computer 802 with the blade tip angle tilt sensor 604.

The computational system 800 can further include a three-axis gyroscope interface 816, which interfaces the computer 802 with the three-axis gyroscope 606.

The computational system 800 can further include a hydraulic system interface 818, which interfaces the computer 802 with the hydraulic system 530.

The computational system 800 can further include an auxiliary sensors interface 820, which interfaces the computer 802 with auxiliary sensors 830. Examples of auxiliary sensors 830 include a global navigation satellite system receiver and an optical receiver.

Each of the interfaces described above can operate over different physical media. Examples of physical media include wires, optical fibers, free-space optics, and electromagnetic waves (typically in the radiofrequency range and commonly referred to as a wireless interface).

As is well known, a computer operates under control of computer software, which defines the overall operation of the computer and applications. The CPU 804 controls the overall operation of the computer and applications by executing computer program instructions that define the overall operation and applications. The computer program instructions can be stored in the data storage device 808 and loaded into the memory 806 when execution of the program instructions is desired. The automatic blade slope angle control algorithms shown schematically in FIG. 5A, FIG. 5B, FIG. 6A, and FIG. 6B can be defined by computer program instructions stored in the memory 806 or in the data storage device 808 (or in a combination of the memory 806 and the data storage device 808) and controlled by the CPU 804 executing the computer program instructions. For example, the computer program instructions can be implemented as computer executable code programmed by one skilled in the art to perform algorithms. Accordingly, by executing the computer program instructions, the CPU 804 executes the automatic blade slope angle control algorithms shown schematically in FIG. 5A, FIG. 5B, FIG. 6A, and FIG. 6B.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A method for controlling a blade mounted on a vehicle, the method comprising the steps of:

receiving at a first time a first computed roll angle estimate and a first computed pitch angle estimate, wherein the first computed roll angle estimate and the first computed pitch angle estimate are based at least in part on a first angular velocity measurement about a first axis, a second angular velocity measurement about a second axis, and a third angular velocity measurement about a third axis from a three-axis gyroscope mounted on the blade, wherein the first axis, the second axis, and the third axis are orthogonal;

receiving at a second time a second computed roll angle estimate and a second computed pitch angle estimate, wherein the second computed roll angle estimate and the second computed pitch angle estimate are based at least in part on a fourth angular velocity measurement about the first axis, a fifth angular velocity measurement about the second axis, and a sixth angular velocity measurement about the third axis from the three-axis gyroscope mounted on the blade;

receiving at a third time a blade slope angle measurement from a blade slope angle tilt sensor mounted on the blade;

receiving at a fourth time a blade tip angle measurement from a blade tip angle tilt sensor mounted on the blade;

determining whether a first time condition is satisfied, wherein the first time condition is represented by:

the third time is greater than the first time and less than or equal to the second time;

upon determining that the first time condition is satisfied:

determining whether the received blade slope angle measurement is valid;

determining whether a second time condition is satisfied, wherein the second time condition is represented by:

the fourth time is greater than the first time and less than or equal to the second time;

upon determining that the second time condition is satisfied:

determining whether the received blade tip angle measurement is valid; and upon determining that the first time condition is satisfied, the received blade slope angle measurement is valid, the second time condition is satisfied, and the received blade tip angle measurement is valid:

computing with a processor an estimate of the blade slope angle based at least in part on the received second computed roll angle estimate, the received second computed pitch angle estimate, the received blade slope angle measurement, and the received blade tip angle measurement.

2. The method of claim 1, further comprising the steps of:

upon determining that the first time condition is not satisfied and the second time condition is not satisfied:

computing an estimate of the blade slope angle based at least in part on the received second computed roll angle estimate and the received second computed pitch angle estimate;

upon determining that the first time condition is satisfied, the received blade slope angle measurement is not valid, and the second time condition is not satisfied:

computing an estimate of the blade slope angle based at least in part on the received second computed roll angle estimate and the received second computed pitch angle estimate;

upon determining that the first time condition is not satisfied, the second time condition is satisfied, and the received blade tip angle is not valid:

computing an estimate of the blade slope angle based at least in part on the received second computed roll angle estimate and the received second computed pitch angle estimate; and upon determining that the first time condition is satisfied, the received blade slope angle measurement is not valid, the second time condition is satisfied, and the received blade tip angle is not valid:

computing an estimate of the blade slope angle based at least in part on the received second computed roll angle estimate and the received second computed pitch angle.

3. The method of claim 1, further comprising the steps of:

upon determining that the first time condition is satisfied, the received blade slope angle measurement is valid, and the second time condition is not satisfied:

computing an estimate of the blade slope angle based at least in part on the received second computed roll angle estimate, the received second computed pitch angle estimate, and the received blade slope angle measurement; and upon determining that the first time condition is satisfied, the received blade slope angle measurement is valid, the second time condition is satisfied, and the received blade tip angle measurement is not valid:

computing an estimate of the blade slope angle based at least in part on the received second computed roll angle estimate, the received second computed pitch angle estimate, and the received blade slope angle measurement.

4. The method of claim 1, further comprising the steps of:

upon determining that the first time condition is not satisfied, the second time condition is satisfied, and the received blade tip angle is valid:

computing an estimate of the blade slope angle based at least in part on the received second computed roll angle estimate, the received second computed pitch angle estimate, and the received blade tip angle measurement; and upon determining that the first time condition is satisfied, the received blade slope angle measurement is not valid, the second time condition is satisfied, and the received blade tip angle measurement is valid:

computing an estimate of the blade slope angle based at least in part on the received second computed roll angle estimate, the received second computed pitch angle estimate, and the received blade tip angle measurement.

5. The method of claim 1, further comprising the steps of:

receiving a reference blade slope angle; and controlling the blade slope angle based at least in part on the received reference blade slope angle and the computed estimate of the blade slope angle.

6. The method of claim 1, further comprising the steps of:

receiving a reference blade slope angle;

computing an estimate of the fourth angular velocity based at least in part on the fourth angular velocity measurement, the fifth angular velocity measurement, the sixth angular velocity measurement, the received blade slope angle measurement, and the received blade tip angle measurement; and controlling the blade slope angle based at least in part on the received reference blade slope angle, the computed estimate of the blade slope angle, and the computed estimate of the fourth angular velocity.

7. The method of claim 1, wherein the step of computing an estimate of the blade slope angle comprises the steps of:

determining a first estimate of a bias of the fourth angular velocity measurement;

determining a first estimate of a bias of the fifth angular velocity measurement;

computing a first estimate of a roll angle based at least in part on the fourth angular velocity measurement, the fifth angular velocity measurement, the sixth angular velocity measurement, the determined first estimate of the bias of the fourth angular velocity measurement, and the determined first estimate of the bias of the fifth angular velocity measurement; and computing a first estimate of a pitch angle based at least in part on the fourth angular velocity measurement, the fifth angular velocity measurement, and the sixth angular velocity measurement, the determined first estimate of the bias of the fourth angular velocity measurement, and the determined first estimate of the bias of the fifth angular velocity measurement.

8. The method of claim 7, further comprising the step of:

computing a corrected estimate of the roll angle, a corrected estimate of the pitch angle, a corrected estimate of the bias of the fourth angular velocity measurement, and a corrected estimate of the bias of the fifth angular velocity measurement based at least in part on the fourth angular velocity measurement, the fifth angular velocity measurement, the sixth angular velocity measurement, the received blade slope angle measurement, the received blade tip angle measurement, the determined first estimate of the bias of the fourth angular velocity measurement, and the determined first estimate of the bias of the fifth angular velocity measurement.

9. The method of claim 1, wherein the vehicle comprises an earthmoving machine.

10. The method of claim 9, wherein the earthmoving machine comprises a motor grader.

11. The method of claim 9, wherein the earthmoving machine comprises a bulldozer.

12. The method of claim 1, wherein the blade comprises a screed and the vehicle comprises a paver.

13. An apparatus for controlling a blade mounted on a vehicle, the apparatus comprising:

a processor;

memory operably coupled to the processor; and a data storage device operably coupled to the processor, wherein the data storage device stores computer program instructions, which, when executed by the processor, causes the processor to perform a method comprising the steps of:

receiving at a first time a first computed roll angle estimate and a first computed pitch angle estimate, wherein the first computed roll angle estimate and the first computed pitch angle estimate are based at least in part on a first angular velocity measurement about a first axis, a second angular velocity measurement about a second axis, and a third angular velocity measurement about a third axis from a three-axis gyroscope mounted on the blade, wherein the first axis, the second axis, and the third axis are orthogonal;

receiving at a second time a second computed roll angle estimate and a second computed pitch angle estimate, wherein the second computed roll angle estimate and the second computed pitch angle estimate are based at least in part on a fourth angular velocity measurement about the first axis, a fifth angular velocity measurement about the second axis, and a sixth angular velocity measurement about the third axis from the three-axis gyroscope mounted on the blade;

receiving at a third time a blade slope angle measurement from a blade slope angle tilt sensor mounted on the blade;

receiving at a fourth time a blade tip angle measurement from a blade tip angle tilt sensor mounted on the blade;

determining whether a first time condition is satisfied, wherein the first time condition is represented by:

the third time is greater than the first time and less than or equal to the second time;

upon determining that the first time condition is satisfied:

determining whether the received blade slope angle measurement is valid;

determining whether a second time condition is satisfied, wherein the second time condition is represented by:

the fourth time is greater than the first time and less than or equal to the second time;

upon determining that the second time condition is satisfied:

determining whether the received blade tip angle measurement is valid; and upon determining that the first time condition is satisfied, the received blade slope angle measurement is valid, the second time condition is satisfied, and the received blade tip angle measurement is valid:

computing an estimate of the blade slope angle based at least in part on the received second computed roll angle estimate, the received second computed pitch angle estimate, the received blade slope angle measurement, and the received blade tip angle measurement.

14. The apparatus of claim 13, wherein the method further comprises the steps of:

upon determining that the first time condition is not satisfied and the second time condition is not satisfied:

computing an estimate of the blade slope angle based at least in part on the received second computed roll angle estimate and the received second computed pitch angle estimate;

upon determining that the first time condition is satisfied, the received blade slope angle measurement is not valid, and the second time condition is not satisfied:

computing an estimate of the blade slope angle based at least in part on the received second computed roll angle estimate and the received second computed pitch angle estimate;

upon determining that the first time condition is not satisfied, the second time condition is satisfied, and the received blade tip angle is not valid:

computing an estimate of the blade slope angle based at least in part on the received second computed roll angle estimate and the received second computed pitch angle estimate; and upon determining that the first time condition is satisfied, the received blade slope angle measurement is not valid, the second time condition is satisfied, and the received blade tip angle is not valid:

computing an estimate of the blade slope angle based at least in part on the received second computed roll angle estimate and the received second computed pitch angle.

15. The apparatus of claim 13, wherein the method further comprises the steps of:

upon determining that the first time condition is satisfied, the received blade slope angle measurement is valid, and the second time condition is not satisfied:

computing an estimate of the blade slope angle based at least in part on the received second computed roll angle estimate, the received second computed pitch angle estimate, and the received blade slope angle measurement; and upon determining that the first time condition is satisfied, the received blade slope angle measurement is valid, the second time condition is satisfied, and the received blade tip angle measurement is not valid:

computing an estimate of the blade slope angle based at least in part on the received second computed roll angle estimate, the received second computed pitch angle estimate, and the received blade slope angle measurement.

16. The apparatus of claim 13, wherein the method further comprises the steps of:

upon determining that the first time condition is not satisfied, the second time condition is satisfied, and the received blade tip angle is valid:

computing an estimate of the blade slope angle based at least in part on the received second computed roll angle estimate, the received second computed pitch angle estimate, and the received blade tip angle measurement; and upon determining that the first time condition is satisfied, the received blade slope angle measurement is not valid, the second time condition is satisfied, and the received blade tip angle measurement is valid:

computing an estimate of the blade slope angle based at least in part on the received second computed roll angle estimate, the received second computed pitch angle estimate, and the received blade tip angle measurement.

17. The apparatus of claim 13, wherein the method further comprises the steps of:

receiving a reference blade slope angle; and controlling the blade slope angle based at least in part on the received reference blade slope angle and the computed estimate of the blade slope angle.

18. The apparatus of claim 13, wherein the method further comprises the steps of:

receiving a reference blade slope angle;

computing an estimate of the fourth angular velocity based at least in part on the fourth angular velocity measurement, the fifth angular velocity measurement, the sixth angular velocity measurement, the received blade slope angle measurement, and the received blade tip angle measurement; and controlling the blade slope angle based at least in part on the received reference blade slope angle, the computed estimate of the blade slope angle, and the computed estimate of the fourth angular velocity.

19. The apparatus of claim 13, wherein the step of computing an estimate of the blade slope angle comprises the steps of:

determining a first estimate of a bias of the fourth angular velocity measurement;

determining a first estimate of a bias of the fifth angular velocity measurement;

computing a first estimate of a roll angle based at least in part on the fourth angular velocity measurement, the fifth angular velocity measurement, the sixth angular velocity measurement, the determined first estimate of the bias of the fourth angular velocity measurement, and the determined first estimate of the bias of the fifth angular velocity measurement; and computing a first estimate of a pitch angle based at least in part on the fourth angular velocity measurement, the fifth angular velocity measurement, and the sixth angular velocity measurement, the determined first estimate of the bias of the fourth angular velocity measurement, and the determined first estimate of the bias of the fifth angular velocity measurement.

20. The apparatus of claim 19, wherein the method further comprises the step of:

computing a corrected estimate of the roll angle, a corrected estimate of the pitch angle, a corrected estimate of the bias of the fourth angular velocity measurement, and a corrected estimate of the bias of the fifth angular velocity measurement based at least in part on the fourth angular velocity measurement, the fifth angular velocity measurement, the sixth angular velocity measurement, the received blade slope angle measurement, the received blade tip angle measurement, the determined first estimate of the bias of the fourth angular velocity measurement, and the determined first estimate of the bias of the fifth angular velocity measurement.

21. The apparatus of claim 13, wherein the vehicle comprises an earthmoving machine.

22. The apparatus of claim 21, wherein the earthmoving machine comprises a motor grader.

23. The apparatus of claim 21, wherein the earthmoving machine comprises a bulldozer.

24. The apparatus of claim 13, wherein the blade comprises a screed and the vehicle comprises a paver.

25. A computer readable medium storing computer program instructions for controlling a blade mounted on a vehicle, wherein the computer program instructions, when executed by a processor, causes the processor to perform a method comprising the steps of:

receiving at a first time a first computed roll angle estimate and a first computed pitch angle estimate, wherein the first computed roll angle estimate and the first computed pitch angle estimate are based at least in part on a first angular velocity measurement about a first axis, a second angular velocity measurement about a second axis, and a third angular velocity measurement about a third axis from a three-axis gyroscope mounted on the blade, wherein the first axis, the second axis, and the third axis are orthogonal;

receiving at a second time a second computed roll angle estimate and a second computed pitch angle estimate, wherein the second computed roll angle estimate and the second computed pitch angle estimate are based at least in part on a fourth angular velocity measurement about the first axis, a fifth angular velocity measurement about the second axis, and a sixth angular velocity measurement about the third axis from the three-axis gyroscope mounted on the blade;

receiving at a third time a blade slope angle measurement from a blade slope angle tilt sensor mounted on the blade;

receiving at a fourth time a blade tip angle measurement from a blade tip angle tilt sensor mounted on the blade;

determining whether a first time condition is satisfied, wherein the first time condition is represented by:

the third time is greater than the first time and less than or equal to the second time;

upon determining that the first time condition is satisfied:

determining whether the received blade slope angle measurement is valid;

determining whether a second time condition is satisfied, wherein the second time condition is represented by:

the fourth time is greater than the first time and less than or equal to the second time;

upon determining that the second time condition is satisfied:

determining whether the received blade tip angle measurement is valid; and upon determining that the first time condition is satisfied, the received blade slope angle measurement is valid, the second time condition is satisfied, and the received blade tip angle measurement is valid:

computing an estimate of the blade slope angle based at least in part on the received second computed roll angle estimate, the received second computed pitch angle estimate, the received blade slope angle measurement, and the received blade tip angle measurement.

26. The computer readable medium of claim 25, wherein the method further comprises the steps of:

upon determining that the first time condition is not satisfied and the second time condition is not satisfied:

computing an estimate of the blade slope angle based at least in part on the received second computed roll angle estimate and the received second computed pitch angle estimate;

upon determining that the first time condition is satisfied, the received blade slope angle measurement is not valid, and the second time condition is not satisfied:

computing an estimate of the blade slope angle based at least in part on the received second computed roll angle estimate and the received second computed pitch angle estimate;

upon determining that the first time condition is not satisfied, the second time condition is satisfied, and the received blade tip angle is not valid:

computing an estimate of the blade slope angle based at least in part on the received second computed roll angle estimate and the received second computed pitch angle estimate; and upon determining that the first time condition is satisfied, the received blade slope angle measurement is not valid, the second time condition is satisfied, and the received blade tip angle is not valid:

computing an estimate of the blade slope angle based at least in part on the received second computed roll angle estimate and the received second computed pitch angle.

27. The computer readable medium of claim 25, wherein the method further comprises the steps of:

upon determining that the first time condition is satisfied, the received blade slope angle measurement is valid, and the second time condition is not satisfied:

computing an estimate of the blade slope angle based at least in part on the received second computed roll angle estimate, the received second computed pitch angle estimate, and the received blade slope angle measurement; and upon determining that the first time condition is satisfied, the received blade slope angle measurement is valid, the second time condition is satisfied, and the received blade tip angle measurement is not valid:

computing an estimate of the blade slope angle based at least in part on the received second computed roll angle estimate, the received second computed pitch angle estimate, and the received blade slope angle measurement.

28. The computer readable medium of claim 25, wherein the method further comprises the steps of:

upon determining that the first time condition is not satisfied, the second time condition is satisfied, and the received blade tip angle is valid:

computing an estimate of the blade slope angle based at least in part on the received second computed roll angle estimate, the received second computed pitch angle estimate, and the received blade tip angle measurement; and upon determining that the first time condition is satisfied, the received blade slope angle measurement is not valid, the second time condition is satisfied, and the received blade tip angle measurement is valid:

computing an estimate of the blade slope angle based at least in part on the received second computed roll angle estimate, the received second computed pitch angle estimate, and the received blade tip angle measurement.

29. The computer readable medium of claim 25, wherein the method further comprises the steps of:

receiving a reference blade slope angle; and controlling the blade slope angle based at least in part on the received reference blade slope angle and the computed estimate of the blade slope angle.

30. The computer readable medium of claim 25, wherein the method further comprises the steps of:

receiving a reference blade slope angle;

computing an estimate of the fourth angular velocity based at least in part on the fourth angular velocity measurement, the fifth angular velocity measurement, the sixth angular velocity measurement, the received blade slope angle measurement, and the received blade tip angle measurement; and controlling the blade slope angle based at least in part on the received reference blade slope angle, the computed estimate of the blade slope angle, and the computed estimate of the fourth angular velocity.

31. The computer readable medium of claim 25, wherein the step of computing an estimate of the blade slope angle comprises the steps of:

determining a first estimate of a bias of the fourth angular velocity measurement;

determining a first estimate of a bias of the fifth angular velocity measurement;

computing a first estimate of a roll angle based at least in part on the fourth angular velocity measurement, the fifth angular velocity measurement, the sixth angular velocity measurement, the determined first estimate of the bias of the fourth angular velocity measurement, and the determined first estimate of the bias of the fifth angular velocity measurement; and computing a first estimate of a pitch angle based at least in part on the fourth angular velocity measurement, the fifth angular velocity measurement, and the sixth angular velocity measurement, the determined first estimate of the bias of the fourth angular velocity measurement, and the determined first estimate of the bias of the fifth angular velocity measurement.

32. The computer readable medium of claim 31, wherein the method further comprises the step of:

computing a corrected estimate of the roll angle, a corrected estimate of the pitch angle, a corrected estimate of the bias of the fourth angular velocity measurement, and a corrected estimate of the bias of the fifth angular velocity measurement based at least in part on the fourth angular velocity measurement, the fifth angular velocity measurement, the sixth angular velocity measurement, the received blade slope angle measurement, the received blade tip angle measurement, the determined first estimate of the bias of the fourth angular velocity measurement, and the determined first estimate of the bias of the fifth angular velocity measurement.

33. The computer readable medium of claim 25, wherein the vehicle comprises an earthmoving machine.

34. The computer readable medium of claim 33, wherein the earthmoving machine comprises a motor grader.

35. The computer readable medium of claim 33, wherein the earthmoving machine comprises a bulldozer.

36. The computer readable medium of claim 25, wherein the blade comprises a screed and the vehicle comprises a paver.

* * * * *